US012049376B2

(12) United States Patent
Miyamoto

(10) Patent No.: US 12,049,376 B2
(45) Date of Patent: Jul. 30, 2024

(54) PAPER FOLDING DEVICE

(71) Applicant: DUPLO SEIKO CORPORATION, Kinokawa (JP)

(72) Inventor: Chikara Miyamoto, Kinokawa (JP)

(73) Assignee: DUPLO SEIKO CORPORATION, Kinokawa (JP)

( * ) Notice: Subject to any disclaimer, the term of this patent is extended or adjusted under 35 U.S.C. 154(b) by 0 days.

(21) Appl. No.: 17/776,096

(22) PCT Filed: Nov. 24, 2020

(86) PCT No.: PCT/JP2020/043582
§ 371 (c)(1),
(2) Date: May 11, 2022

(87) PCT Pub. No.: WO2021/106835
PCT Pub. Date: Jun. 3, 2021

(65) Prior Publication Data

US 2022/0388803 A1 Dec. 8, 2022

(30) Foreign Application Priority Data

Nov. 26, 2019 (JP) ..... JP2019-212833

(51) Int. Cl.
*B31B 70/26* (2017.01)
*B65H 45/16* (2006.01)

(52) U.S. Cl.
CPC ..... *B65H 45/16* (2013.01); *B65H 2403/942* (2013.01); *B65H 2404/15* (2013.01); *B65H 2701/1123* (2013.01)

(58) Field of Classification Search
CPC ..... B65H 45/16; B65H 2701/1123; B65H 2701/11238; B31B 70/26; B31B 70/52; B31B 70/261
(Continued)

(56) References Cited

U.S. PATENT DOCUMENTS 3,166,996 A 1/1965 Sauerman
4,403,981 A * 9/1983 Wuthrich ..... B65H 29/008 493/453
4,985,013 A 1/1991 Van et al.
4,997,175 A * 3/1991 Hashida ..... B65H 45/12 270/45
5,090,671 A * 2/1992 Gombault ..... B65H 45/14 270/47
(Continued)

FOREIGN PATENT DOCUMENTS

DE 873036 C 4/1953
GB 2 397 816 A 8/2004
(Continued)

OTHER PUBLICATIONS

International Preliminary Report on Patentability issued in International Patent Application No. PCT/JP2020/043582, dated May 17, 2022 (4 pages).
(Continued)

*Primary Examiner* — Leslie A Nicholson, III
(74) *Attorney, Agent, or Firm* — BUCHANAN INGERSOLL & ROONEY PC

(57) ABSTRACT

A paper folding device that folds a planar paper sheet while conveying the paper sheet along a paper sheet conveyance surface includes a pair of first conveyance rollers disposed on an upstream side in a paper sheet conveyance direction, a pair of second conveyance rollers disposed on a downstream side in the paper sheet conveyance direction, a switching gate plate installed on the paper sheet conveyance surface between both pairs of the rollers, a folding plate disposed above the switching gate plate, and a control unit that controls an operation of an entire device.

8 Claims, 15 Drawing Sheets

(58) Field of Classification Search
USPC ..... 270/32; 493/419, 435, 442
See application file for complete search history.

(56) References Cited

U.S. PATENT DOCUMENTS

| | | | | |
|---|---|---|---|---|
| 5,339,603 | A * | 8/1994 | Gombault | B43M 3/04 53/284.3 |
| 5,490,829 | A * | 2/1996 | Beord | B65H 45/14 493/419 |
| 6,939,280 | B2 * | 9/2005 | Iddon | B65H 45/12 493/23 |
| 8,257,238 | B2 * | 9/2012 | Eijkelkamp | B65H 45/18 493/434 |
| 11,230,139 | B2 * | 1/2022 | DePoi | B43M 5/047 |
| 2004/0154487 | A1 | 8/2004 | Iddon | |
| 2017/0205751 | A1 | 7/2017 | Hirano et al. | |

FOREIGN PATENT DOCUMENTS

| | | | |
|---|---|---|---|
| JP | 2003312939 | A | 11/2003 |
| JP | 2016026975 | A | 2/2016 |
| JP | 2017128411 | A | 7/2017 |
| WO | 2019043760 | A1 | 3/2019 |

OTHER PUBLICATIONS

International Search Report (PCT/ISA/210) with translation and Written Opinion (PCT/ISA/237) dated Jan. 19, 2021, by the Japan Patent Office as the International Searching Authority for International Application No. PCT/JP2020/043582.

Extended European Search Resport issued in European Patent Application No. 20892462.1, dated Dec. 15, 2023 (8 pages).

* cited by examiner

PAPER FOLDING DEVICE

TECHNICAL FIELD

The present invention relates to a paper folding device. Specifically, the present invention relates to a paper folding device suitable for a bag making machine for manufacturing an envelope.

BACKGROUND ART

Conventionally, a paper folding device (for example, Patent Document 1) that folds a medium such as a paper sheet is configured as follows: the paper sheet is conveyed, a leading end side of the paper sheet is inserted into a paper sheet insertion space (diverging path), by continuing conveyance on a trailing end side of the paper sheet even after the leading end of the paper sheet abuts a stopper provided in the paper sheet insertion space and is prevented from proceeding, the paper sheet is bent outside the paper sheet insertion space to form a curved portion, the curved portion is sandwiched between a pair of rollers and pulled in, and the paper sheet is folded over to fold the medium.

PRIOR ART DOCUMENT

Patent Document

Patent Document 1: Japanese Patent Laid-open Publication No. 2003-312939

SUMMARY OF THE INVENTION

Problems to be Solved by the Invention

Conventionally, in a buckle-folding type paper folding device including a folding tray, when a front surface portion 101 illustrated in FIG. 4 is crimped to piece portions 103, the piece portions 103 are bent along a press roller (not illustrated). Therefore, wrinkles may be formed at portions of folds of the piece portions 103. Regarding this problem, according to the technique disclosed in Patent Document 1, since the folded piece portions 103 are conveyed only along a conveyance surface constituting the same plane as a conveyance surface of a folding unit in a paper sheet discharge direction without bending the folded piece portions along the press roller, it is possible to eliminate curving of the folded piece portions 103 at the folding unit. Therefore, wrinkles can be prevented from being generated in the folded piece portion, and as a result, a western envelope having a good appearance can be obtained.

However, in the paper folding device provided with the stopper as in the technique disclosed in Patent Document 1 described above, it is necessary to adjust a stopper position in accordance with various folding specifications, and when the stopper position is adjusted, it is necessary for an operator to manually adjust the stopper position or to provide an automatic moving mechanism of the stopper in the device. In a case where the operator manually adjusts the stopper position, the operation is complicated and the usability is not good. In addition, in a case where the automatic movement mechanism of the stopper is provided in the device, the operability is good, but the cost is high.

Furthermore, in the technique disclosed in Patent Document 1, in the case of conveying and folding a paper sheet to which a glue is applied, there is a possibility that the glue adheres to the inside of a folding mechanism such as a stopper, and adversely affects the quality of a product.

In view of the above-described problems in the conventional paper sheet folding device, an object of the present invention is to provide a paper folding device that prevents wrinkles from being generated in a folded piece portion, that can be configured simply and inexpensively without complicating a structure, and that has good operability, and that does not cause an adverse effect on the quality of a product due to adhesion of glue to the inside of a folding mechanism such as a stopper even when a paper sheet to which glue is applied is conveyed and folded.

Solutions to the Problems

In order to achieve the above object, the invention recited in claim 1 is a paper folding device that folds a planar paper sheet while conveying the paper sheet along a paper sheet conveyance surface, the paper folding device including: a pair of first conveyance rollers disposed on an upstream side in a paper sheet conveyance direction; a pair of second conveyance rollers disposed on a downstream side in the paper sheet conveyance direction; a switching gate plate installed on the paper sheet conveyance surface between both pairs of the rollers; a folding plate disposed above the switching gate plate; and a control unit that controls an operation of an entire device, wherein the switching gate plate is switchable between a first guide position at which the switching gate plate interferes with the conveyed paper sheet and guides a leading end portion of the paper sheet upward so as to pass through an upper surface of an upper roller of the pair of second conveyance rollers and a second guide position at which the switching gate plate guides the leading end portion of the paper sheet toward a nip portion of the pair of second conveyance rollers along the paper sheet conveyance surface, the folding plate is configured to be movable in a vertical direction in a substantially horizontal state, and is switchable between a folding position close to the switching gate plate disposed at the second guide position and a retracting position retracted at a predetermined interval from the switching gate plate, and the control unit performs control to, after guiding the leading end portion of the paper sheet to be conveyed by the switching gate plate disposed at the first guide position so as to pass through the upper surface of the upper roller of the pair of second conveyance rollers by a predetermined amount, switch the switching gate plate to the second guide position, and then lower the folding plate disposed at the retracting position to the folding position in a substantially horizontal state so as to sandwich the paper sheet on the switching gate plate, thereby folding back the leading end portion of the paper sheet along a surface of the upper roller of the pair of second conveyance rollers.

According to the invention recited in claim 2, in the paper folding device recited in claim 1, the control unit performs control such that after the leading end portion of the paper sheet is folded back by lowering the folding plate, a leading end fold-back portion of the paper sheet after the leading end portion of the paper sheet is folded back is further conveyed toward the nip portion of the pair of second conveyance rollers by the pair of first conveyance rollers, and the leading end fold-back portion of the paper sheet is sandwiched and conveyed by the nip portion of the pair of second conveyance rollers to press and fold the leading end fold-back portion of the paper sheet.

According to the invention recited in claim 3, in the paper folding device recited in claim 2, the switching gate plate is further switchable upward toward the pair of first conveyance rollers as a third guide position, the pair of first conveyance rollers and the pair of second conveyance rollers are configured to be able to perform forward rotation and reverse rotation, and the control unit performs control to retract the folding plate to the retracting position and switch the switching gate plate upward toward the pair of first conveyance rollers as the third guide position after the pair of second conveyance rollers press the leading end fold-back portion of the paper sheet, then switch the switching gate plate to the second guide position to guide the paper sheet along the paper sheet conveyance surface toward a nip portion of the pair of first conveyance rollers after guiding a rear end portion of the paper sheet upward so as to pass through an upper surface of an upper roller of the pair of first conveyance rollers by a predetermined amount by reversely rotating the pair of second conveyance rollers and conveying the paper sheet in a reverse direction from the downstream side to the upstream side, and then fold back the rear end portion of the paper sheet along a surface of the upper roller of the pair of first conveyance rollers by lowering the folding plate to the folding position in a substantially horizontal state so as to sandwich the paper sheet on the switching gate plate.

According to the invention recited in claim 4, in the paper folding device recited in claim 3, the control unit performs control such that after the folding plate is lowered to fold back the rear end portion of the paper sheet, a rear end fold-back portion of the paper sheet after the rear end portion of the paper sheet is folded back is further conveyed toward the nip portion of the pair of first conveyance rollers by the pair of second conveyance rollers, and the pair of first conveyance rollers are reversely rotated to sandwich and convey the rear end fold-back portion of the paper sheet at the nip portion of the pair of first conveyance rollers, thereby pressing the rear end fold-back portion of the paper sheet.

According to the invention recited in claim 5, in the paper folding device recited in any one of claims 1 to 4, a crease processing unit is further provided on the upstream side in the paper sheet conveyance direction of the pair of first conveyance rollers, and the crease processing unit is configured to form a crease in advance in a fold line when the planar paper sheet is folded.

According to the invention recited in claim 6, in the paper folding device recited in any one of claims 1 to 5, a distance by which the switching gate plate disposed at the second guide position and the folding plate disposed at the folding position approach each other is set such that at least a gap that allows the paper sheet to be conveyed is secured between the folding plate and the switching gate plate.

The invention recited in claim 7 is a bag making machine including the paper folding device recited in any one of claims 1 to 6.

The invention recited in claim 8 is a paper folding device that folds a planar paper sheet while conveying the paper sheet along a conveyance surface, the paper folding device including: a pair of first conveyance rollers disposed on an upstream side in a paper sheet conveyance direction; a pair of second conveyance rollers disposed on a downstream side in the paper sheet conveyance direction; a switching gate plate installed on a paper sheet conveyance surface between both pairs of the rollers; a folding plate disposed to face the switching gate plate; and a control unit that controls an operation of an entire device, wherein the switching gate plate is switchable between a first guide position at which the switching gate plate interferes with the conveyed paper sheet, bends the paper sheet conveyance direction outward from the paper sheet conveyance surface, and guides a leading end portion of the paper sheet toward a surface of one roller of the pair of second conveyance rollers and a second guide position at which the switching gate plate guides the leading end portion of the paper sheet along the paper sheet conveyance surface toward a nip portion of the pair of second conveyance rollers, the folding plate is configured to be movable toward the switching gate plate in a substantially horizontal state, and is switchable between a folding position close to the switching gate plate disposed at the second guide position and a retracting position retracted at a predetermined interval from the switching gate plate, and the control unit performs control such that after the leading end portion of the paper sheet to be conveyed is guided by the switching gate plate disposed at the first guide position so as to pass by a predetermined amount toward the surface of one roller of the pair of second conveyance rollers, the switching gate plate is switched to the second guide position, and then the folding plate disposed at the retracting position is lowered to the folding position in a substantially horizontal state so as to sandwich the paper sheet on the switching gate plate, whereby the leading end portion of the paper sheet is folded back along the surface of one roller of the pair of second conveyance rollers.

Effects of the Invention

According to the invention recited in claim 1, since it is not necessary to provide the paper sheet insertion space (diverging path) and the stopper as the paper folding mechanism, it is possible to simply and inexpensively configure the paper folding mechanism without complicating the structure. In addition, since the folding position is automatically adjusted in accordance with various folding specifications by the control unit, it is possible to provide a paper folding device with good operability. Furthermore, wrinkles are prevented from being generated in the folded piece portions, and even in the case of folding, glue does not adhere to the inside of the folding mechanism such as the stopper, and the quality of the product is not adversely affected.

According to the invention recited in claim 2, after the leading end portion of the paper sheet is folded back by lowering the folding plate, the leading end fold-back portion of the paper sheet after being folded back is controlled to be pressed and folded by the nip portion of the pair of second conveyance rollers, so that it is possible to reliably impart a folding habit to the paper sheet.

According to the invention recited in claim 3, since the two positions of the front end portion and the rear end portion in the paper sheet conveyance direction can be folded back on the same folding mechanism, the work efficiency is good. In addition, space saving and inexpensive configuration can be achieved.

According to the invention recited in claim 4, after the front end portion and the rear end portion in the conveyance direction of the paper sheet are folded back by lowering of the folding plate, the nip portion of the pair of second conveyance rollers and the nip portion of the pair of first conveyance rollers are controlled to press and fold the paper sheet, so that it is possible to reliably impart a folding habit to the paper sheet.

According to the invention recited in claim 5, a crease processing unit is further provided on the upstream side in the paper sheet conveyance direction of the pair of first conveyance rollers, and the crease processing unit is configured to form a crease in advance in a fold line when the planar paper sheet is folded to form a fold starting point, so that the paper sheet can be folded cleanly and accurately. In addition, it is possible to suppress print cracking that occurs at the time of folding the paper sheet.

According to the invention recited in claim 6, after the leading end portion of the paper sheet is folded back by lowering of the folding plate, the leading end fold-back portion of the paper sheet after being folded back is conveyed while being guided by the gap between the adjacent switching gate plate and the folding plate, so that it is possible to reliably transfer the leading end fold-back portion to a pressing processing unit by the nip portion of the pair of conveyance rollers at the next stage without generating wrinkles or the like.

According to the invention recited in claim 7, by using the paper folding device for folding the paper sheet in the present invention in a bag making machine for manufacturing an envelope, the entire device can be configured simply and inexpensively, and operability is good, which is preferable.

According to the invention recited in claim 8, since it is not necessary to provide the paper sheet insertion space (diverging path) and the stopper as the paper folding mechanism, it is possible to simply and inexpensively configure the paper folding mechanism without complicating the structure. In addition, since the folding position is automatically adjusted in accordance with various folding specifications by the control unit, it is possible to provide a paper folding device with good operability.

EMBODIMENTS OF THE INVENTION

Figure 1:
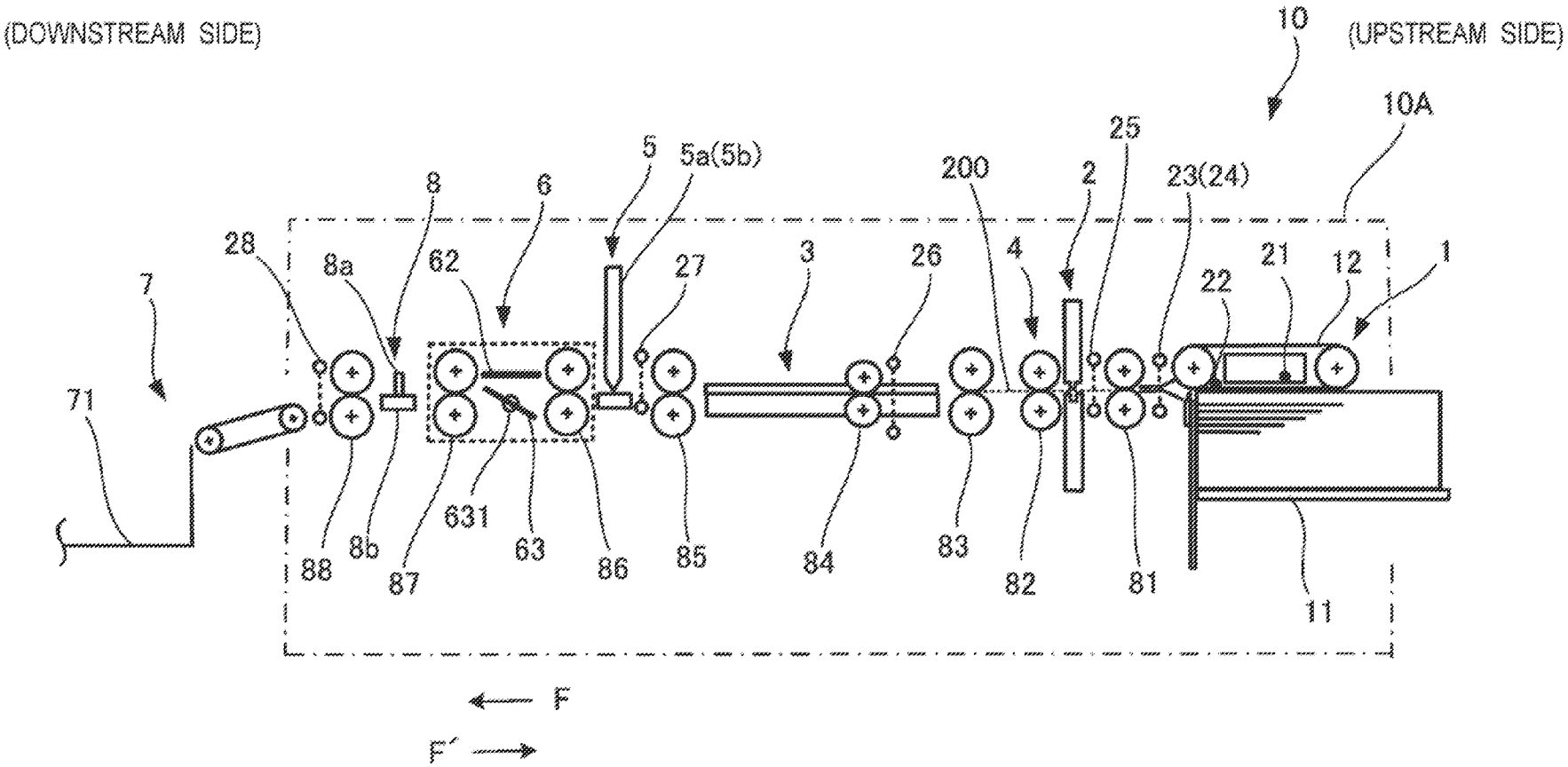
FIG. 1 is a schematic overall configuration diagram of a bag making machine according to a first embodiment of the present invention.

FIG. 1 illustrates a bag making machine 10 according to an embodiment that employs a paper folding device (second folding unit 6) of the present invention. FIG. 1 is an overall configuration diagram of the bag making machine 10. The bag making machine 10 includes a paper feeding unit 1, a first crease processing unit 2, a second crease processing unit 4, a first folding unit 3, a glue application unit 5, a second folding unit 6, and a paper ejection unit 7 in this order from an upstream side in a conveyance direction in a device body 10A.

Figure 4:
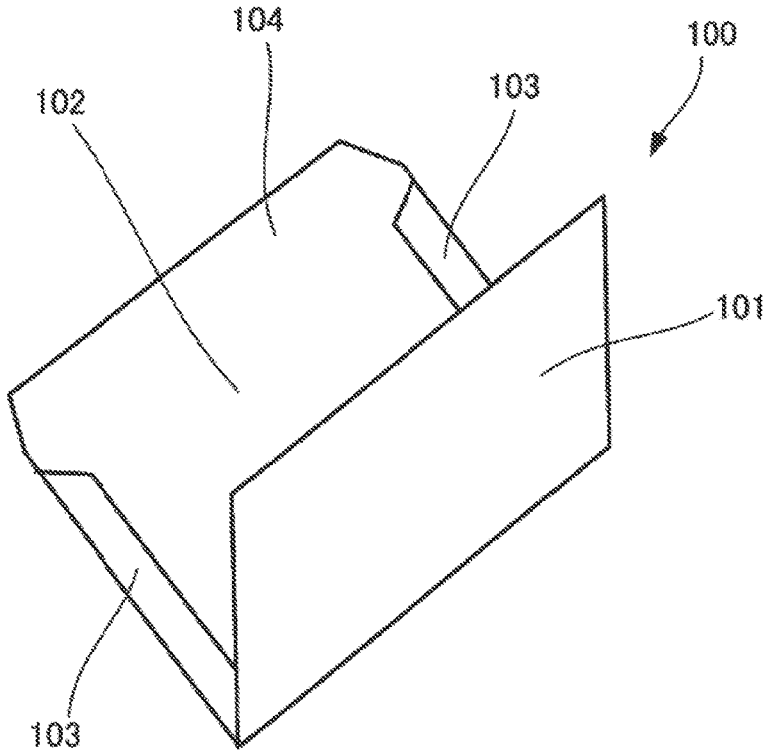
FIG. 4 is a perspective view illustrating a state in the middle of manufacturing a western envelope.

A "western envelope" of a general form has a horizontally long rectangle, and a sealing port is formed on a long side. When the western envelope is manufactured by the bag making machine 10, for example, as illustrated in FIG. 4, glue is applied to folded piece portions 103 on both sides of a rear surface portion 102 of a paper sheet 100, and a front surface portion 101 is folded back and crimped to the piece portions 103.

Figure 2A:
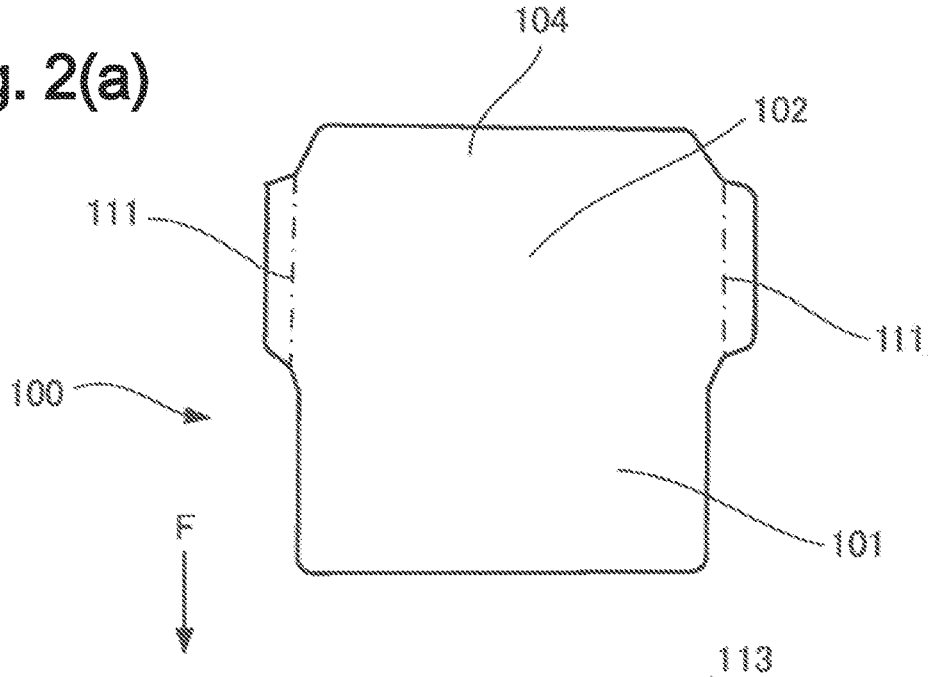
FIGS. 2(*a*)-2(*c*) are plan views illustrating a state of a paper sheet processed by the bag making machine in FIG. 1.
Figure 2B:
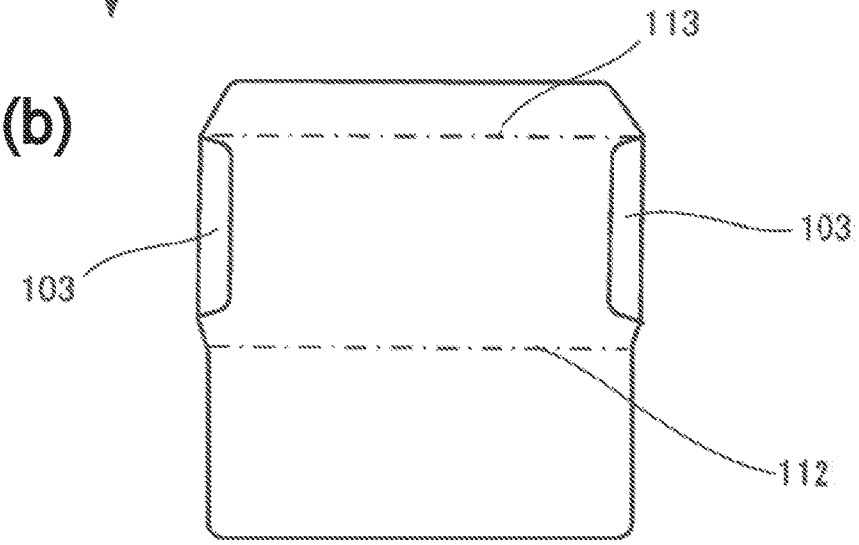
Figure 2C:
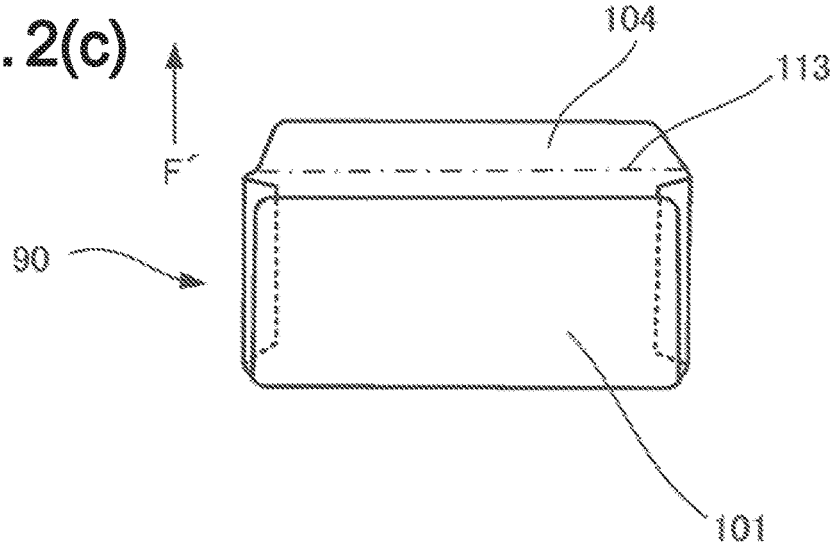

Specifically, the bag making machine 10 manufactures a western envelope 90 by processing the planar paper sheet 100 illustrated in FIG. 2(*a*) as illustrated in FIGS. 2(*b*) and 2(*c*) while conveying the paper sheet in an F direction.

The paper sheet 100 includes the front surface portion 101, the rear surface portion 102, the glue substitute piece portions 103 protruding to both sides of the rear surface portion 102, and a rearmost surface portion 104. As illustrated in FIG. 2(*b*), the paper sheet 100 is folded at first fold lines 111 which are boundary lines between the rear surface portion 102 and the piece portions 103, and further folded at a second fold line 112 which is a boundary line between the front surface portion 101 and the rear surface portion 102 as illustrated in FIG. 2(*c*). A glue is applied to the surfaces of the piece portions 103 folded back at the first fold lines 111. Both edge portions of the front surface portion 101 folded back at the second fold line 112 are joined to the piece portions 103. Note that the first fold lines 111 extend along the conveyance direction. The second fold line 112 is along a direction orthogonal to the conveyance direction (that is, a width direction).

Figure 3A:
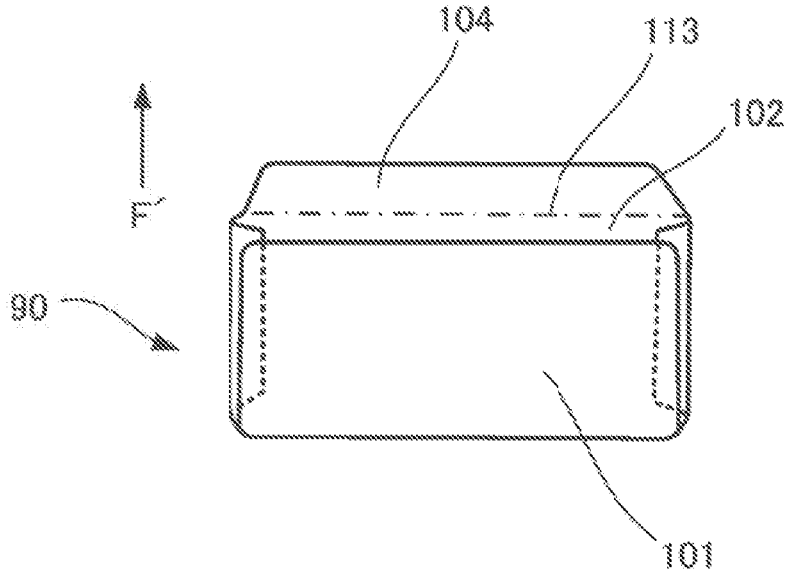
FIGS. 3(*a*) and 3(*b*) are plan views illustrating a state in which the paper sheet of FIG. 2 is folded.
Figure 3B:
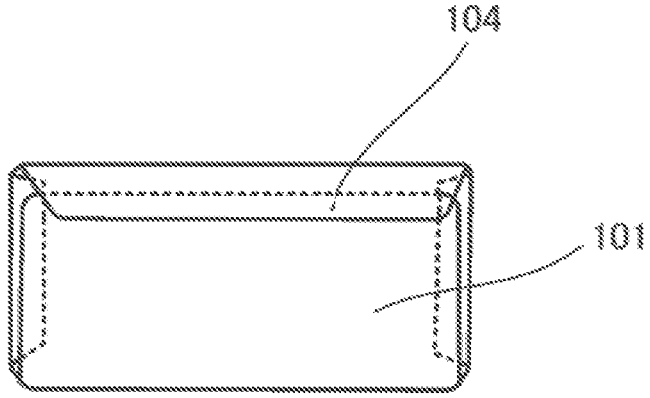

As a product, the western envelope 90 of FIG. 2(*c*) may be used, but by processing the western envelope 90 illustrated in FIG. 2(*c*) as illustrated in FIG. 3 while conveying the envelope 90 in an F' direction, the rearmost surface portion 104 may be further folded along a third fold line 113 which is a boundary line between the rear surface portion 102 and the rearmost surface portion 104. According to the above configuration, when the contents are inserted into the envelope and then sealed using a tape or a glue, the front surface portion 101 on which the rearmost surface portion 104 is folded back can be sealed cleanly since there is a folding habit.

[Paper Feeding Unit 1]

The paper feeding unit 1 includes an air suction belt-type air paper feeding unit 12, an elevator-type paper feeding tray 11 that ascends and descends according to a paper sheet loading amount, and a pair of conveyance rollers 81 that further convey the paper sheet fed by the air paper feeding unit 12 to a downstream side in the conveyance direction. Further, the air paper feeding unit 12 includes a sensor 22 that detects that an uppermost paper sheet of the paper sheets stacked on the paper feeding tray 11 is attracted to a lower surface of the air paper feeding unit 12, and a sensor 21 that detects an upper limit position of the uppermost paper sheet of the paper sheets stacked on the paper feeding tray 11.

Note that the bag making machine 10 includes seven pairs of conveyance rollers 82, 83, 84, 85, 86, 87, and 88 in addition to the pair of conveyance rollers 81. The seven pairs of conveyance rollers constitute a conveyance surface 200 on which the paper sheet 100 is conveyed, and the conveyance surface 200 is flush from the air paper feeding unit 12 to the pair of conveyance rollers 88. Furthermore, on the conveyance surface 200 on which the paper sheet is conveyed, a sensor 23, a sensor 24, a sensor 25, a sensor 26, a sensor 27, and a sensor 28 that detect passage of the paper sheet at each position (detect double feed) are disposed. Each sensor uses, for example, an optical transmission sensor.

[First Crease Processing Unit 2]

As illustrated in FIG. 1, the first crease processing unit 2 includes an upper mold having a convex upper portion and a lower mold having a concave lower portion, and forms a lateral crease in a direction perpendicular to the paper sheet conveyance direction as the second fold line 112 and the third fold line 113 of the paper sheet 100. As the crease processing unit 2, a known mechanism can be employed.

[Second Crease Processing Unit 4]

As illustrated in FIG. 1, the second crease processing unit 4 includes an upper blade having a circular blade shape of a crease blade and a convex portion formed on an outer peripheral portion, and a lower blade having a circular blade shape and a concave portion formed on an outer peripheral portion. The second crease processing unit 4 is installed at two positions in the width direction perpendicular to the conveyance direction, and forms longitudinal creases along the paper sheet conveyance direction on the first fold lines 111 (two positions) of the paper sheet 100. As the second crease processing unit 4, a known mechanism can be employed.

[First Folding Unit 3]

Figure 17A:
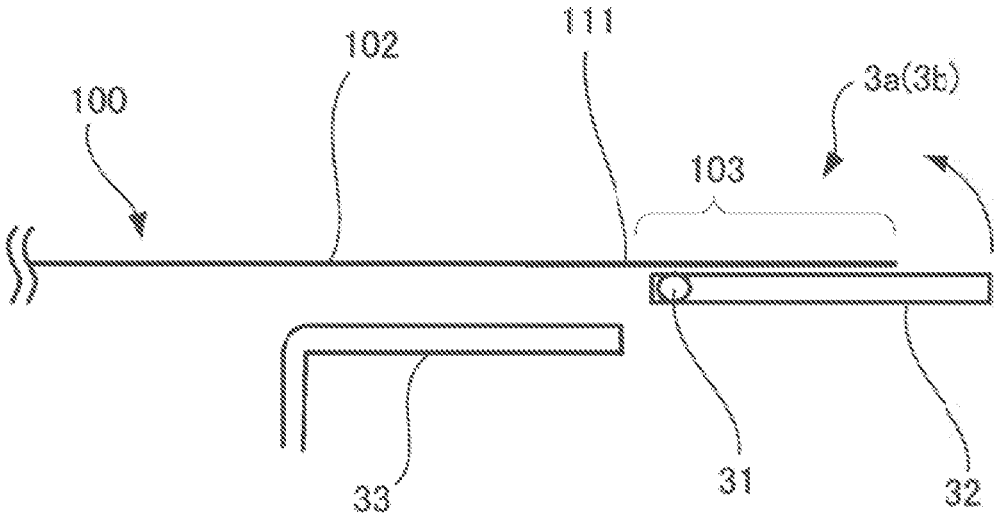
FIGS. 17(*a*) and 17(*b*) are diagrams illustrating a state before and after a flap is folded back at a first folding unit.
Figure 17B:
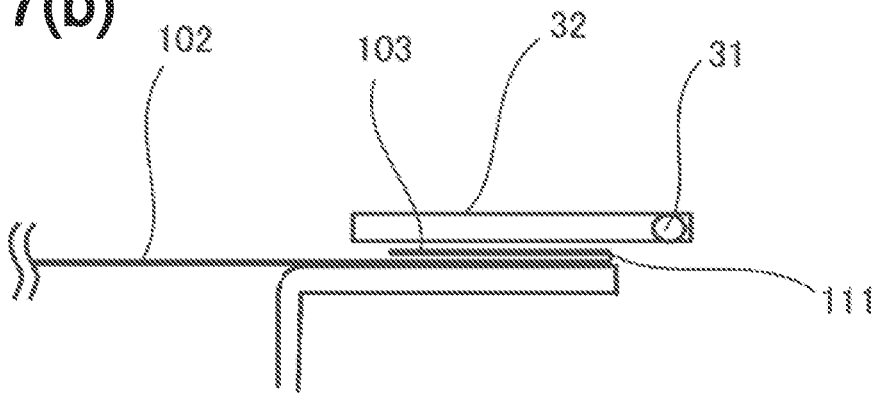
Figure 18A:
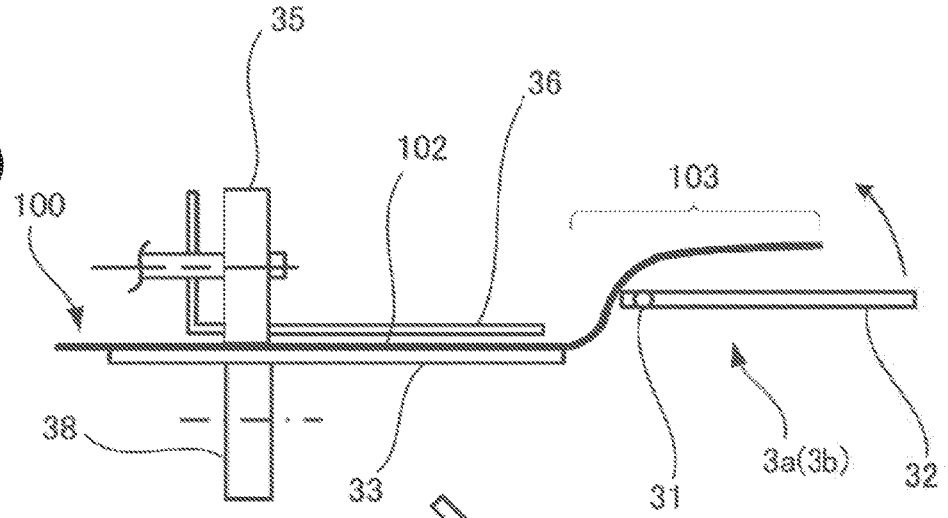
FIGS. 18(*a*)-18(*d*) are diagrams illustrating a state before and after a flap is folded back in another embodiment of the first folding unit.
Figure 18B:
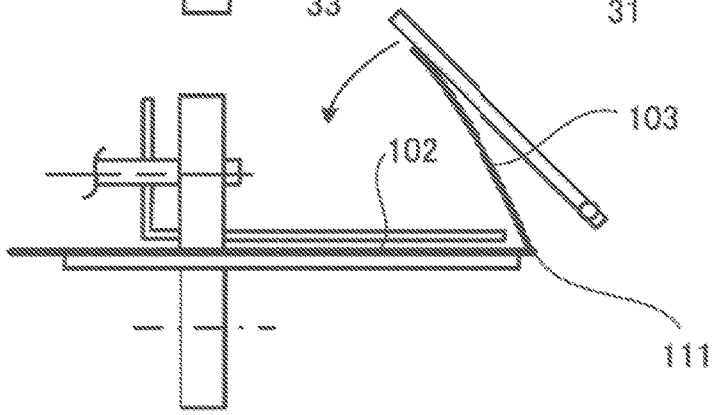
Figure 18C:
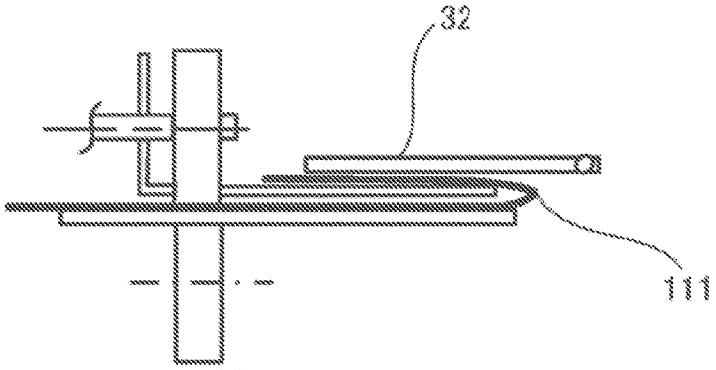
Figure 18D:
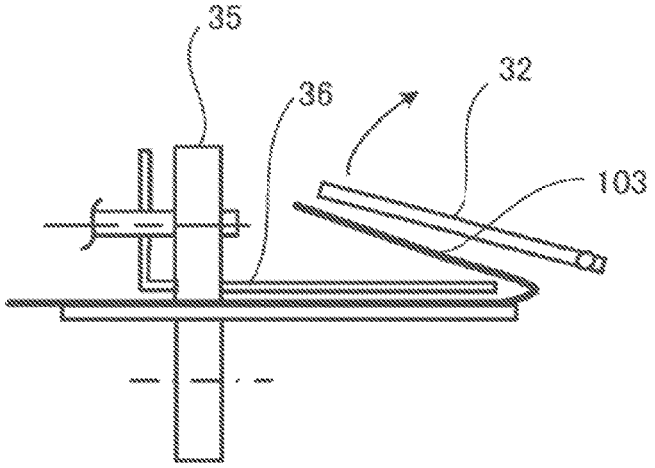

The first folding unit 3 includes a pair of folding devices 3*a* and 3*b* disposed opposite to each other on both sides in the width direction perpendicular to the paper sheet conveyance direction. Each of the folding devices 3*a* and 3*b* includes a flap plate 32 that rotates around a rotation shaft 31 along the conveyance direction, and as illustrated in FIG. 17(*a*), by rotating the flap plate 32 as illustrated in FIG. 17(*b*), the piece portion 103 of the paper sheet 100 placed on the flap plate 32 in a state of being positioned on an outer side in the width direction can be folded inward so as to be aligned with a surface of the rear surface portion 102.

[Glue Application Unit 5]

The glue application unit 5 includes a pair of application devices 5*a* and 5*b* disposed opposite to each other on both sides in the width direction. Note that the application device 5*a* and the application device 5*b* have bilaterally symmetrical configurations.

The application devices 5*a* and 5*b* include nozzle portions, a position setting mechanism, and a vertical drive mechanism (not illustrated). The nozzle portion can apply glue to the conveyed paper sheet at a predetermined timing.

[Second Folding Unit 6]

The second folding unit 6 is a paper folding device that folds the planar paper sheet 100 while conveying the paper sheet along the conveyance surface 200, and includes the pair of first conveyance rollers 86 disposed on the upstream side in the paper sheet conveyance direction, the pair of second conveyance rollers 87 disposed on the downstream side in the paper sheet conveyance direction, a switching gate plate 63 installed between both pairs of the rollers, and a folding plate 62 disposed above the switching gate plate 63.

The switching gate plate 63 is switchable between a first guide position at which the switching gate plate interferes with the conveyed paper sheet 100 and guides a leading end portion of the paper sheet 100 upward so as to pass through an upper surface of an upper roller 871 of the pair of second conveyance rollers 87 and a second guide position at which the switching gate plate guides the leading end portion of the paper sheet 100 in the substantially horizontal direction toward a nip portion 873 of the pair of second conveyance rollers 87, and the folding plate 62 is configured to be movable in the vertical direction while being in the substantially horizontal state, and is switchable between a folding position at which the folding plate approaches the switching gate plate 63 disposed at the second guide position and a retracting position at which the folding plate retracts at a predetermined interval from the switching gate plate.

Drive mechanisms 64 and 65 of the switching gate plate 63 and the folding plate 62 will be described.

Figure 15B:
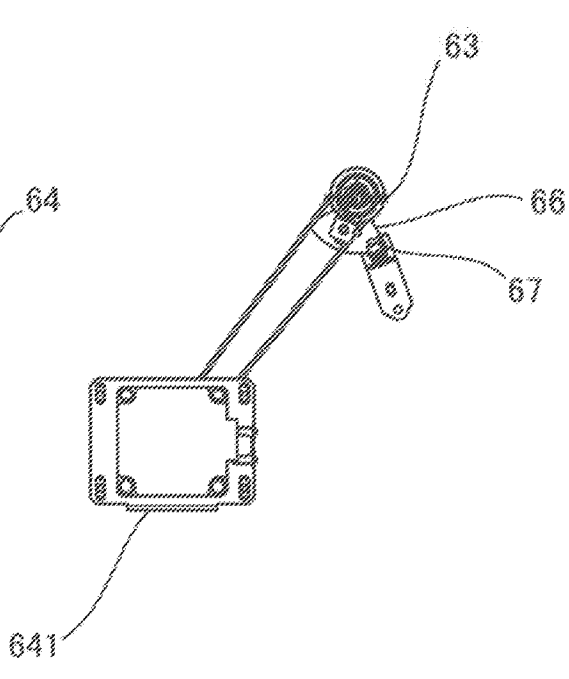
FIGS. 15(*a*) and 15(*b*) are diagrams illustrating a drive mechanism of a switching gate plate in the second folding unit.
Figure 15A:
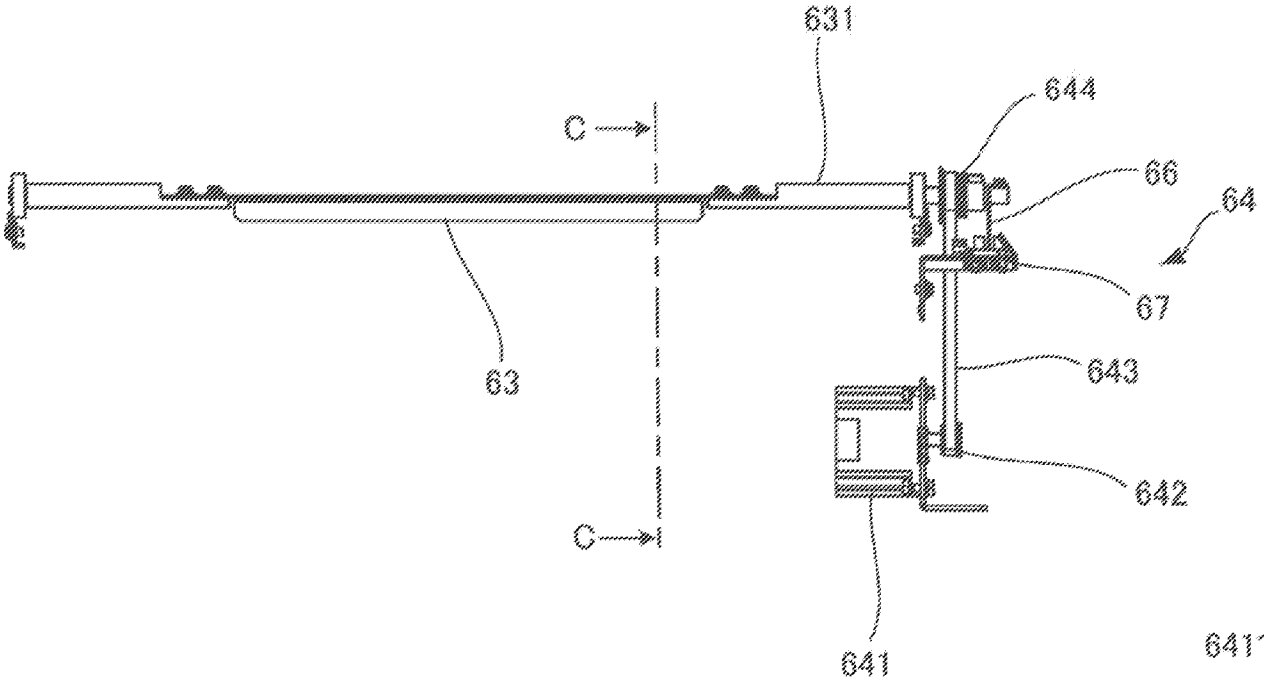
Figure 16B:
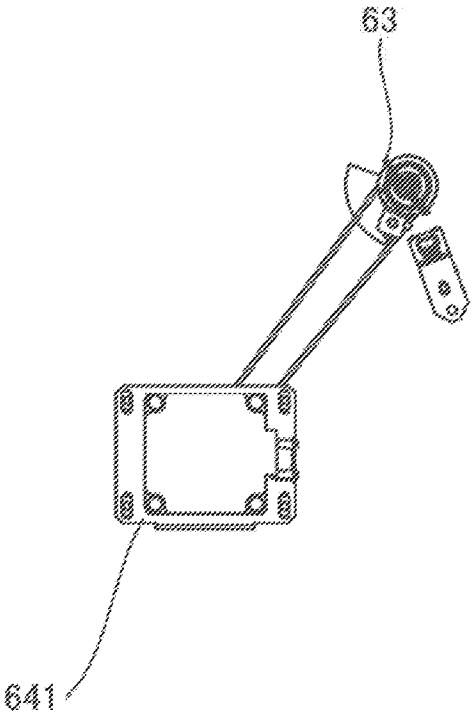
FIGS. 16(*a*) and 16(*b*) are diagrams illustrating the drive mechanism of the switching gate plate in the second folding unit.
Figure 16A:
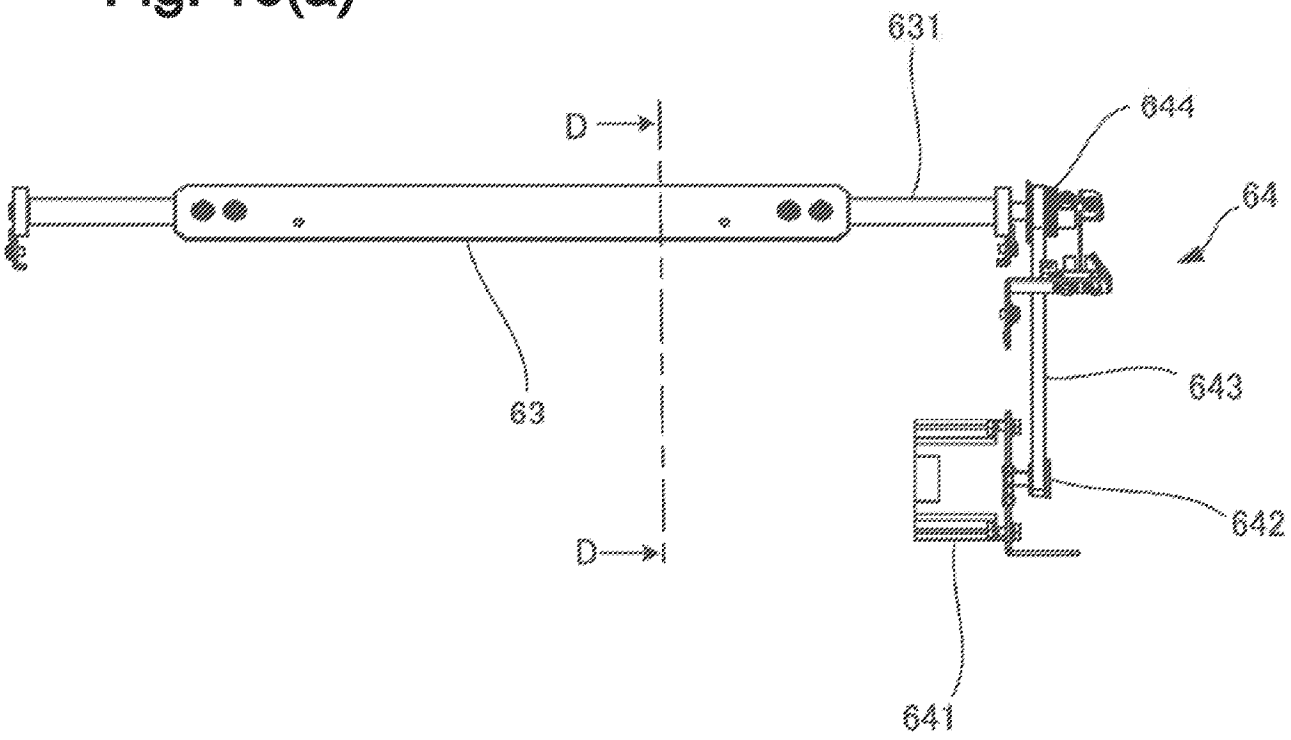

As illustrated in FIGS. 15 and 16, the switching gate plate 63 is selectively disposed at the first guide position and the second guide position described above. FIG. 15 illustrates a state in which the switching gate plate 63 is disposed at the second guide position, and FIG. 16 illustrates a state in which the switching gate plate 63 is disposed at the first guide position.

In FIG. 15, FIG. 15(*a*) is a front view when viewed from the front in the paper sheet conveyance direction, and FIG. 15(*b*) is a cross-sectional view when viewed from a C direction in FIG. 15(*a*). In FIG. 16, FIG. 16(*a*) is a front view when viewed from the front in the paper sheet conveyance direction, and FIG. 16(*b*) is a cross-sectional view when viewed from a D direction in FIG. 16(*a*).

As illustrated in FIGS. 15 and 16, the drive mechanism 64 of the switching gate plate 63 operates as follows. That is, when a motor 641 operates, a second pulley 644 rotates via a first pulley 642 and a transmission belt 643. Since a support shaft 631 of the switching gate plate 63 is connected to the second pulley 644, the switching gate plate 63 rotates when the second pulley 644 rotates. Note that a rotation angle of the switching gate plate 63 can be detected by detecting both edges of a light shielding plate 66 attached to the support shaft 631 of the switching gate plate 63 by a first detection unit 67, whereby the switching gate plate 63 can be selectively disposed at the first guide position and the second guide position.

Figure 13B:
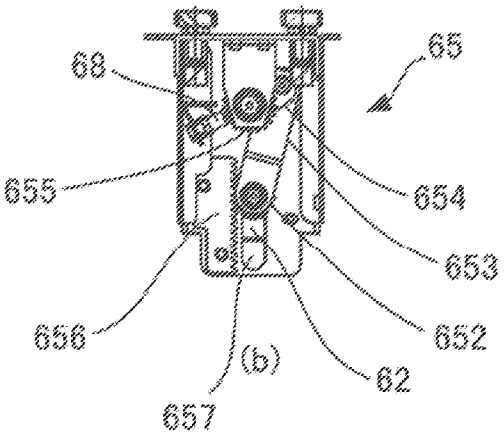
FIGS. 13(*a*) and 13(*b*) are diagrams illustrating a drive mechanism of a folding plate in the second folding unit.
Figure 13A:
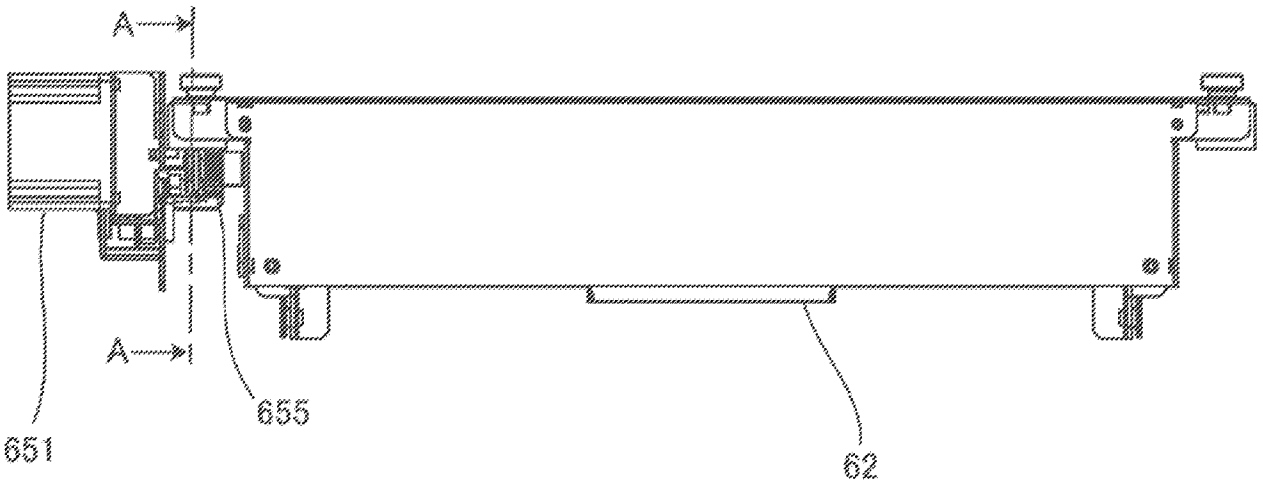
Figure 14B:
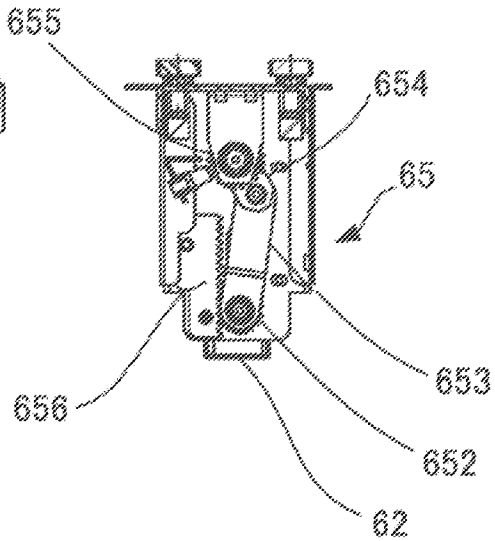
FIGS. 14(*a*) and 14(*b*) are diagrams illustrating the drive mechanism of the folding plate in the second folding unit.
Figure 14A:
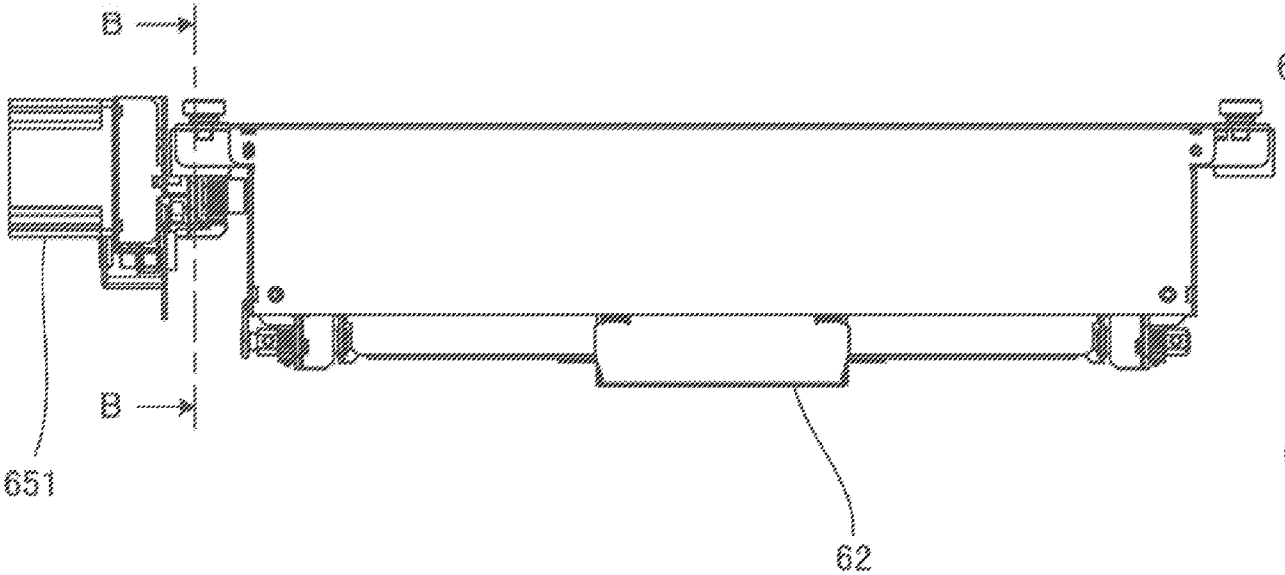

As illustrated in FIGS. 13 and 14, the folding plate 62 is selectively disposed at the folding position and the retracting position described above. FIG. 13 illustrates a state in which the folding plate 62 is disposed at the retracting position, and FIG. 14 illustrates a state in which the folding plate 62 is disposed at the folding position.

In FIG. 13, FIG. 13(*a*) is a front view when viewed from the front in the paper sheet conveyance direction, and FIG. 13(*b*) is a cross-sectional view when viewed from an A direction in FIG. 13(*a*). In FIG. 14, FIG. 14(*a*) is a front view when viewed from the front in the paper sheet conveyance direction, and FIG. 14(*b*) is a cross-sectional view when viewed from a B direction in FIG. 14(*a*).

As illustrated in FIGS. 13 and 14, the drive mechanism 65 of the folding plate 62 operates as follows. That is, when a motor 651 operates, a drive gear (not illustrated) attached to a drive shaft of the motor 651 rotates, and an interlocking gear 655 engaged with the drive gear rotates. A base portion of a second link member 654 is fixed to a rotation shaft of the interlocking gear 655 so as to be rotatable, and one end portion of a first link member 653 is attached to a free end thereof. A pinion 652 is attached to the other end portion of the first link member 653, and the pinion 652 meshes with a rack 656 in an immovable state. Therefore, the first link member 653 converts the rotational motion of the second link member 654 into the linear motion (reciprocating motion) of the pinion 652 on the rack 656. The folding plate 62 is attached to a rotation shaft of the pinion 652, and the folding plate 62 moves up and down (reciprocates) along an elongated hole 657 integrally with the linear motion (reciprocation) of the pinion 652. Note that a vertical position of the folding plate 62 can be detected by detecting both edges of a light shielding plate (not illustrated) attached to the rotation shaft of the interlocking gear 655 by a second detection unit 68, whereby the folding plate 62 can be selectively disposed at the folding position and the retracting position.

[Pressurization Unit 8]

A pressurization unit 8 includes an upper mold 8*a* that can move up and down and an immovable lower mold 8*b*, and further applies pressure by sandwiching a folded part of the paper sheet 100 folded at the second folding unit 6 between the upper mold and the lower mold to strengthen the folded part.

[Paper Ejection Unit 7]

The paper ejection unit 7 includes a pair of conveyance rollers 88 and a paper ejection tray 71. The pair of conveyance rollers 88 are provided to operate as discharge rollers. Specifically, as illustrated in FIG. 1, the pair of conveyance rollers 88 are disposed in the vicinity of the pair of second conveyance rollers 87 of the second folding unit 6 and on the downstream side in the conveyance direction. The paper ejection tray 71 is inclined obliquely upward from a position below the conveyance surface 200 and toward the downstream side in the conveyance direction.

Next, an operation of the bag making machine 10 having the above configuration will be described.

First, the paper sheet 100 illustrated in FIG. 2 is placed on the paper feeding tray 11. At this time, the front surface portion 101 is located on the downstream side in the conveyance direction. Then, a switch (not illustrated) is turned on to start the operation.

(1) The paper sheet 100 on an uppermost surface on the paper feeding tray 11 is sent out toward the pair of conveyance rollers 81 while being attracted by an air suction belt in the air paper feeding unit 12, and after the paper sheet 100 is delivered to the pair of conveyance rollers 81, the paper sheet is further conveyed to the downstream side in the conveyance direction by the pair of conveyance rollers 81. Thereafter, it passes through the first crease processing unit 2. At this time, the first crease processing unit 2 operates to form creases in the second fold line 112 and the third fold line 113 of the paper sheet 100. As a result, the front surface portion 101 is easily folded back toward a side of the rear surface portion 102. The rearmost surface portion 104 is easily folded back toward a side of the folded front surface portion 101.

(2) The paper sheet 100 conveyed from the first crease processing unit 2 passes through the second crease processing unit 4. At this time, the first fold lines 111 (two positions on the left and right in the width direction) of the paper sheet 100 are located immediately below the crease blades (round blades) of the second crease processing unit 4 installed at two positions in the width direction. Then, the second crease processing unit 4 operates to form creases in the first fold lines 111. As a result, the piece portions 103 (two positions on the left and right in the width direction) are easily folded back inward.

(3) The paper sheet 100 on which the creases are formed by the second crease processing unit 4 stops at the first folding unit 3. At this time, the flap plate 32 of each of the folding devices 3*a* and 3*b* of the first folding unit 3 is located on the outer side in the width direction of the paper sheet 100, and the piece portions 103 on both sides of the paper sheet 100 are placed on the flap plates 32 (FIG. 17(*a*)). Note that, in FIG. 17, the paper sheet 100 is conveyed from the front side to the back side in the drawing. Then, the flap plate 32 rotates toward an inner lower guide plate 33, whereby the piece portions 103 are folded inward at the creased first fold lines 111 and aligned with the surface of the rear surface portion 102 (FIG. 17(*b*)). Thereafter, the flap plate 32 rotates in a direction away from the outer lower guide plate 33. Then, the paper sheet 100 on which the piece portions 103 are folded is conveyed downstream in the conveyance direction by the pair of conveyance rollers 85. The flap plate 32 rotated outward is maintained in this state until the next paper sheet 100 comes. Note that the flap plate 32 may operate so as to rotate outward after the paper sheet 100 on which the piece portions 103 are folded is conveyed to the downstream side in the conveyance direction in a state where the flap plate 32 is rotated inward and before the next paper sheet 100 is conveyed.

Next, another embodiment of the first folding unit will be described. In another embodiment illustrated in FIG. 18, the basic configuration of the folding of the piece portion 103 by the flap plate 32 of each of the folding devices 3*a* and 3*b* of the first folding unit 3 is the same as that in FIG. 17 described above, but is different in that an upper guide plate 36 is provided above the lower guide plate 33 with a predetermined gap, and that a pair of rollers (a driving roller 38 and a driven roller 35) that further convey the paper sheet 100 conveyed on the lower guide plate 33 to the downstream side are provided. Note that, in the lower guide plate 33, notches are formed in the nip portion of the pair of rollers.

In FIG. 18(*a*), the flap plate 32 of each of the folding devices 3*a* and 3*b* of the first folding unit 3 is located on the outer side in the width direction, and the piece portions 103 on both sides of the paper sheet 100 are placed on the flap plates 32.

Next, in FIG. 18(*b*), the flap plate 32 rotates toward the inner lower guide plate 33, whereby the piece portion 103 is folded inward at the creased first fold line 111 and aligned on the rear surface portion 102 via the upper guide plate 36 as illustrated in FIG. 18(*c*).

Thereafter, in FIG. 18(*d*), the flap plate 32 rotates in a direction away from the outer lower guide plate 33. Then, the paper sheet 100 on which the piece portions 103 are folded is conveyed downstream in the conveyance direction by the pair of rollers (the driving roller 38 and the driven roller 35). By rotating the flap plate 32 in a direction away from the lower guide plate 33 by at least a predetermined angle before the conveyance of the paper sheet 100 is started, it is possible to prevent the flap plate 32 and the upper guide plate 36 from becoming a load at the time of conveying the paper sheet 100 and to stably convey the paper sheet 100 without generating wrinkles.

In FIGS. 18(*a*) to 18(*d*) described above, the upper guide plate 36 and the driven roller 35 are provided, so that it is possible to prevent the paper sheet from being bent and wrinkled when the paper sheet is folded.

(4) The paper sheet 100 on which the piece portions 103 are folded is conveyed downstream in the conveyance direction by the pair of conveyance rollers 85 and passes through the glue application unit 5. In the glue application unit 5, the nozzle portions 5*a* and 5*b* installed at two positions in the width direction move downward and abut on the surfaces of the piece portions 103 when the folded piece portions 103 on both sides of the paper sheet 100 start to pass, and the nozzle portions 5*a* and 5*b* move upward and the nozzle portions 5*a* and 5*b* are separated from the surfaces of the piece portions 103 when the passage of the piece portions 103 is completed. As a result, the glue is applied to the surfaces of the folded piece portions 103. Note that the folded piece portions 103 pass through the nozzle portions 5*a* and 5*b* in a state of being pressed or after being pressed by the pair of conveyance rollers 85 located upstream of the nozzle portions 5*a* and 5*b* in the conveyance direction. Therefore, the glue application work by the nozzle portions 5*a* and 5*b* can be stably performed.

(Processing of Paper Sheet in Second Folding Unit 6)

The second folding unit 6 is a paper folding device that folds the planar paper sheet 100 while conveying the paper sheet along the conveyance surface 200, and includes the pair of first conveyance rollers 86 disposed on the upstream side in the paper sheet conveyance direction, the pair of second conveyance rollers 87 disposed on the downstream side in the paper sheet conveyance direction, the switching gate plate 63 installed on the paper sheet conveyance surface 200 between both the pairs of the rollers, the folding plate 62 disposed to face the switching gate plate 63, and a control unit (not illustrated) that controls an operation of the entire device.

The switching gate plate 63 is switchable between the first guide position at which the switching gate plate interferes with the conveyed paper sheet 100 to bend the paper sheet conveyance direction outward from the paper sheet conveyance surface 200 and guides the leading end portion of the paper sheet 100 toward a surface of one roller of the pair of second conveyance rollers 87 and the second guide position at which the switching gate plate guides the leading end portion of the paper sheet along the paper sheet conveyance surface 200 toward the nip portion 873 of the pair of second conveyance rollers 87.

The folding plate 62 is configured to be movable toward the switching gate plate 63 in a substantially horizontal state, and can be switched between the folding position close to the switching gate plate 63 disposed at the second guide position and the retracting position retracted at a predetermined interval from the switching gate plate 63.

The control unit performs control to, after guiding the leading end portion of the paper sheet 100 to be conveyed by the switching gate plate 63 disposed at the first guide position so as to pass through a surface of one roller of the pair of second conveyance rollers 87 by a predetermined amount, switch the switching gate plate 63 to the second guide position, and then lower the folding plate 62 disposed at the retracting position to the folding position in a substantially horizontal state so as to sandwich the paper sheet 100 on the switching gate plate 63, thereby folding back the leading end portion of the paper sheet 100 along the surface of one roller of the pair of second conveyance rollers 87.

Specifically, as an embodiment, processing is sequentially performed as shown in the following (5-1) to (5-8).

Figure 5:
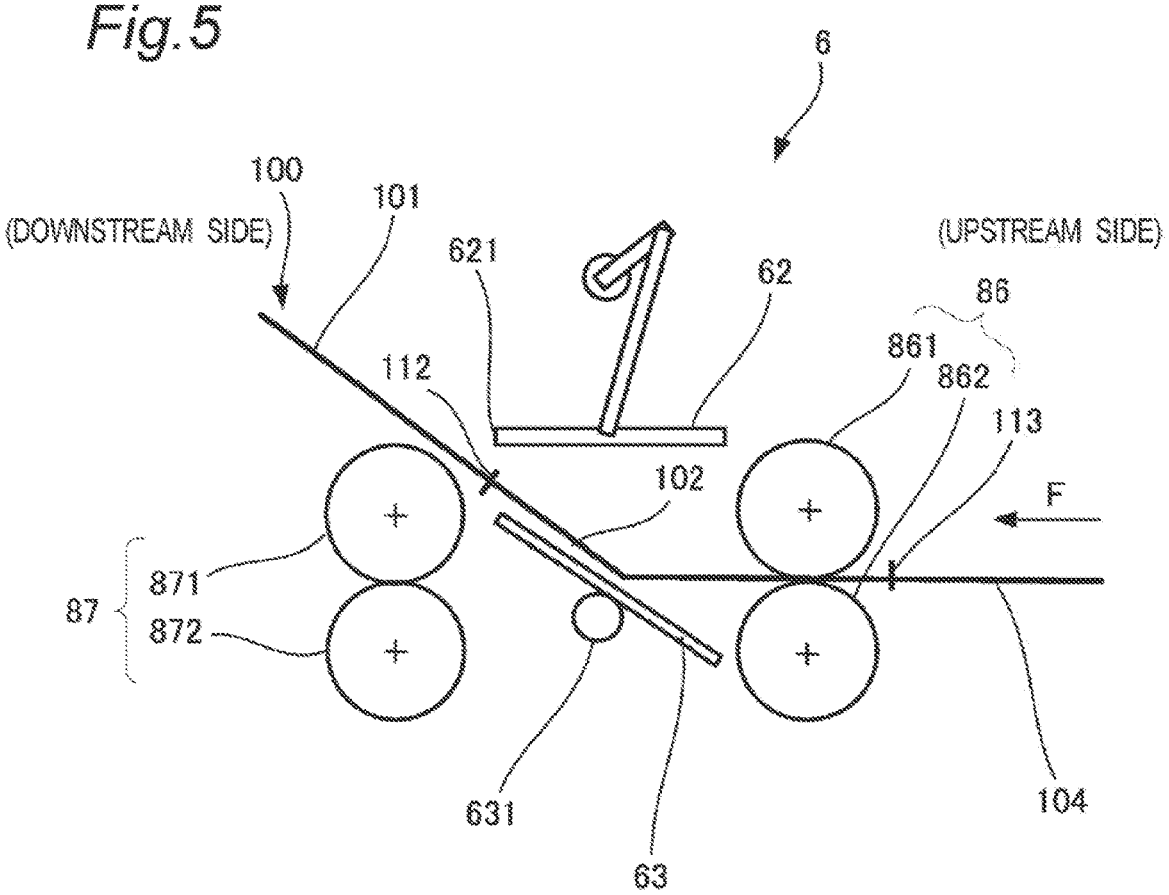
FIG. 5 is a diagram illustrating a state of processing of a paper sheet at a second folding unit.

(5-1) The paper sheet 100 on which the glue has been applied to the piece portions 103 is conveyed (in the F direction) to the second folding unit 6 by the pair of conveyance rollers 85. At this time, the switching gate plate 63 is set upward toward the pair of second conveyance rollers 87 as the first guide position. Therefore, as illustrated in FIG. 5, the paper sheet 100 is guided upward by the switching gate plate 63 such that the leading end portion of the paper sheet 100 passes through the upper surface of the upper roller 871 of the pair of second conveyance rollers 87, and the conveyance is temporarily stopped when a position of the second fold line 112 of the paper sheet 100 reaches the folding position (position immediately below an end portion 621 of the folding plate 62). Note that during this period, the folding plate 62 stays at the retracting position.

Note that, since an upper roller 861 of the pair of first conveyance rollers 86 is set to have a width dimension that does not contact the surface of the piece portion 103, the glue applied to the piece portion 103 of the paper sheet 100 in the glue application unit 5 does not adhere to the pair of first conveyance rollers 86.

Figure 6:
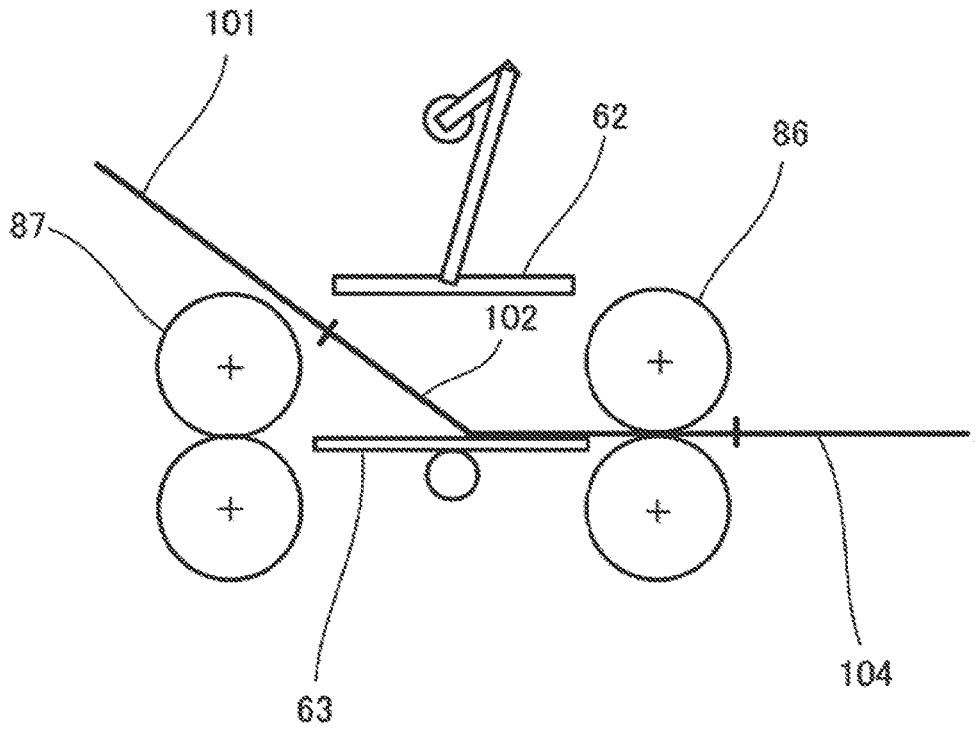
FIG. 6 is a diagram illustrating a state of processing of the paper sheet subsequent to FIG. 5.

(5-2) Next, as illustrated in FIG. 6, the switching gate plate 63 is moved to the second guide position (substantially horizontal position) while the folding plate 62 stays at the retracting position.

Figure 7:
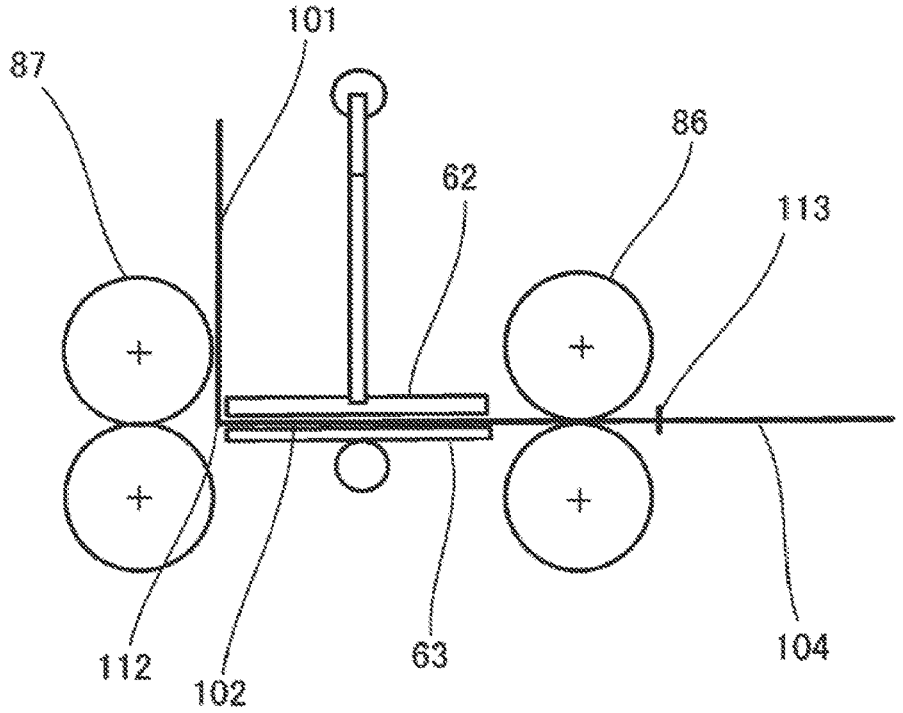
FIG. 7 is a diagram illustrating a state of processing of the paper sheet subsequent to FIG. 6.

(5-3) Next, as illustrated in FIG. 7, the folding plate 62 disposed at the retracting position is lowered to the folding position in a substantially horizontal state so as to sandwich the paper sheet 100 on the switching gate plate 63, whereby the front surface portion 101 of the paper sheet 100 is folded back from the second fold line 112 along the surface of the upper roller 871 of the pair of second conveyance rollers 87. At this time, a distance by which the switching gate plate 63 and the folding plate 62 after lowering approach each other is configured such that at least a gap that allows the paper sheet to be conveyed is secured between the folding plate 62 and the switching gate plate 63. For example, the gap of about 1 mm is secured.

According to the above, since it is not necessary to provide the paper sheet insertion space (diverging path) and the stopper as the paper folding mechanism, it is possible to simply and inexpensively configure the paper folding mechanism without complicating the structure. In addition, since the folding position is automatically adjusted in accordance with various folding specifications by the control unit, it is possible to provide a paper folding device with good operability. Furthermore, wrinkles are prevented from being generated in the folded piece portions, and even in the case of folding, glue does not adhere to the inside of the folding mechanism such as the stopper, and the quality of the product is not adversely affected.

Figure 8:
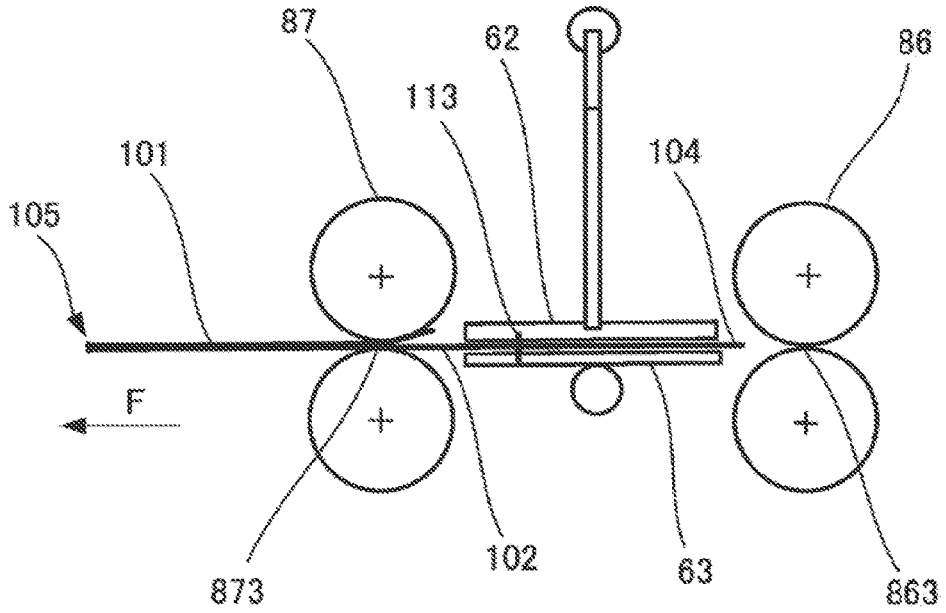
FIG. 8 is a diagram illustrating a state of processing of the paper sheet subsequent to FIG. 7.

(5-4) Next, as illustrated in FIG. 8, after the front surface portion 101 of the paper sheet 100 is folded back by lowering of the folding plate 62, a leading end fold-back portion 105 of the paper sheet after the leading end portion of the paper sheet is folded back is further conveyed toward the nip portion 873 of the pair of second conveyance rollers 87 by the pair of first conveyance rollers 86, and the leading end fold-back portion 105 of the paper sheet is sandwiched by the nip portion 873 of the pair of second conveyance rollers 87 and conveyed in the F direction to press and fold the paper sheet leading end fold-back portion 105. Then, the entire front surface portion 101 is folded back and aligned with the surface of the rear surface portion 102, and at that time, both edge portions of the front surface portion 101 are joined to the piece portions 103. Thus, the western envelope 90 is obtained. Note that conveyance in the F direction is performed until the rearmost surface portion 104 of the paper sheet 100 passes through the nip portion 863 of the pair of first conveyance rollers 86 by a predetermined amount. At this time, the paper sheet 100 is conveyed through the gap between the folding plate 62 and the switching gate plate 63 (while being guided by both the plates). According to this, the paper sheet can be reliably delivered to a pressing processing unit by the nip portion 873 of the pair of second conveyance rollers 87 at the next stage without generating wrinkles or the like.

According to the above, after the leading end portion of the paper sheet is folded back by lowering the folding plate, the control is performed such that the paper sheet leading end fold-back portion after the folding is pressed and folded by the nip portion 873 of the pair of second conveyance rollers 87, and thus, it is possible to reliably add a folding habit to the paper sheet.

As a product, the western envelope 90 may be used, but the rearmost surface portion 104 may be further folded along the third fold line 113 which is a boundary line between the rear surface portion 102 and the rearmost surface portion 104 by folding the western envelope 90 while being reversely conveyed in the F' direction. According to this configuration, when an operator seals the envelope with a tape or a glue after inserting the contents into the envelope, since the envelope has a folding habit, the rearmost surface portion 104 can be sealed cleanly on the folded front surface portion 101. A processing method of folding the rearmost surface portion 104 will be described below.

(5-5) The switching gate plate 63 is further switchable upward toward the pair of first conveyance rollers 86 as a third guide position, and the pair of first conveyance rollers 86 and the pair of second conveyance rollers 87 are configured to be able to perform forward rotation and reverse rotation.

Figure 9:
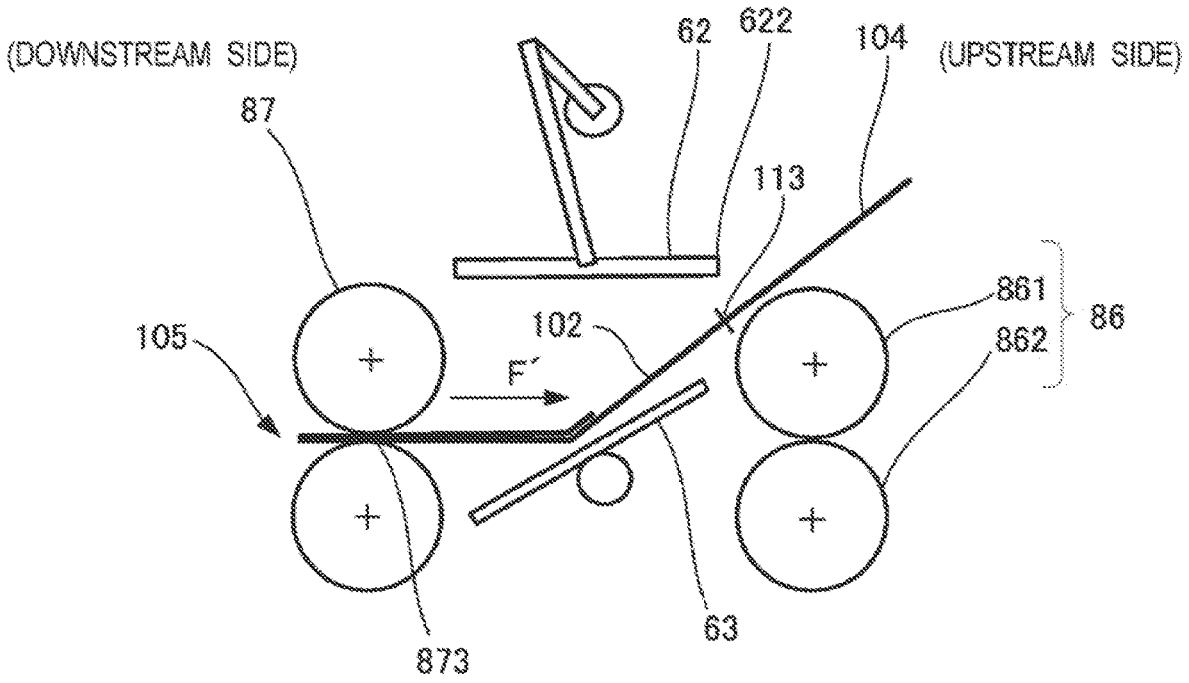
FIG. 9 is a diagram illustrating a state of processing of the paper sheet subsequent to FIG. 8.

As described above, after the pair of second conveyance rollers 87 press the leading end fold-back portion 105 of the paper sheet 100 at the nip portion 873 of the pair of second conveyance rollers 87, as illustrated in FIG. 9, the folding plate 62 is retracted to the retracting position, and the switching gate plate 63 is switched upward toward the pair of first conveyance rollers 86 as the third guide position. Thereafter, the pair of second conveyance rollers 87 are reversely rotated, and the paper sheet 100 is conveyed in a reverse direction from the downstream side to the upstream side in the F' direction. As a result, the rearmost surface portion 104 of the paper sheet is guided upward so as to pass through the upper surface of the upper roller 861 of the pair of first conveyance rollers 86 by a predetermined amount, and the conveyance is temporarily stopped when the position of the third fold line 113 of the paper sheet 100 reaches the folding position (the position immediately below the end portion 622 of the folding plate 62). Note that during this period, the folding plate 62 stays at the retracting position.

Figure 10:
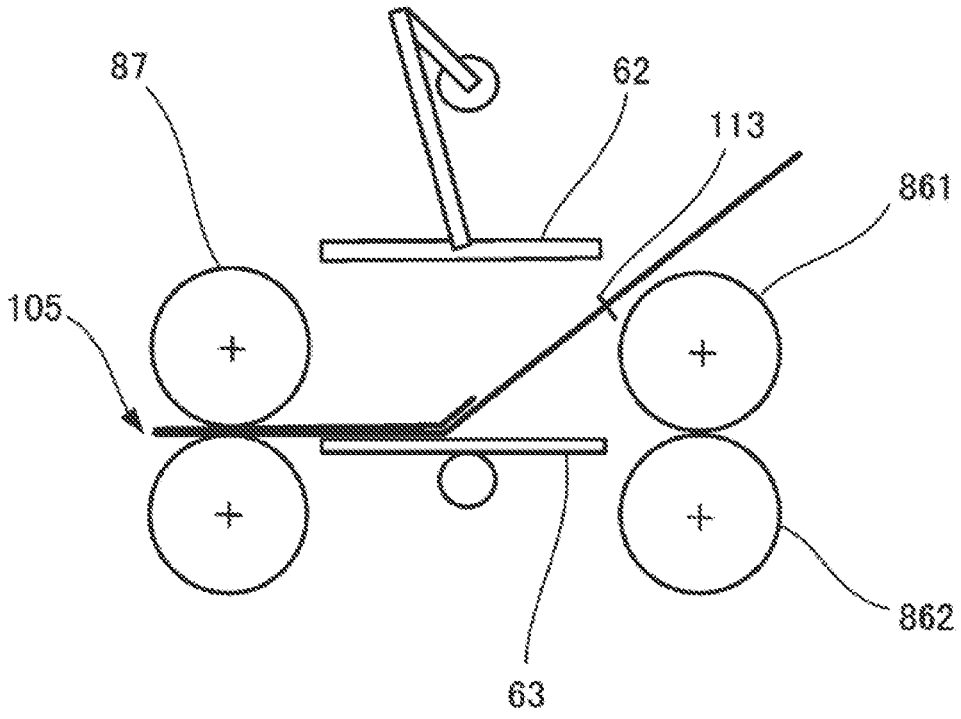
FIG. 10 is a diagram illustrating a state of processing of the paper sheet subsequent to FIG. 9.

(5-6) Next, as illustrated in FIG. 10, the switching gate plate 63 is moved to the second guide position (substantially horizontal position) while the folding plate 62 stays at the retracting position.

Figure 11A:
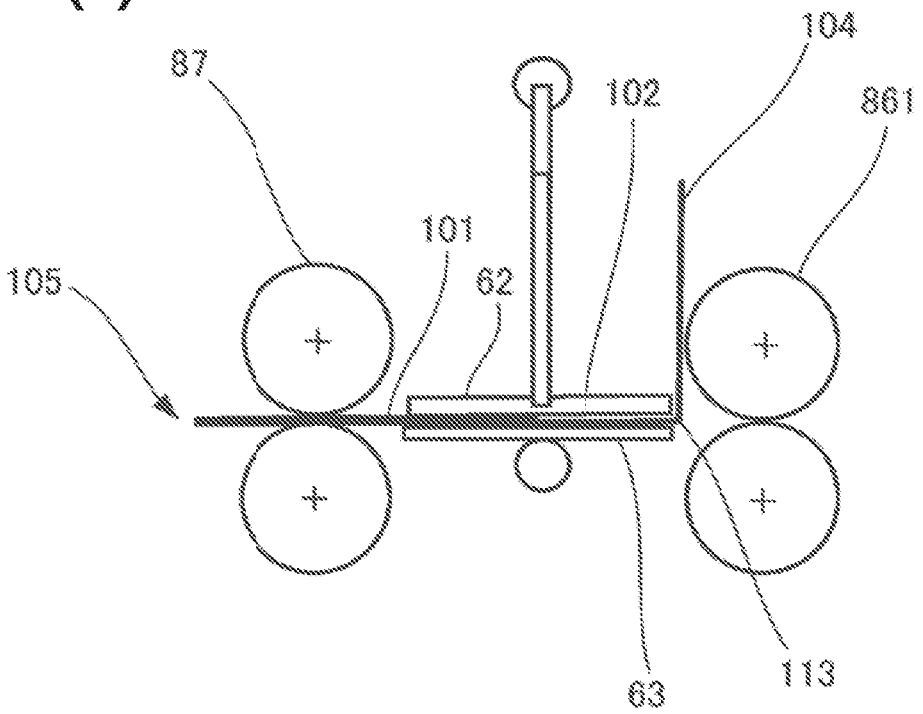
FIGS. 11(*a*) and 11(*b*) are diagrams illustrating a state of processing of the paper sheet subsequent to FIG. 10.
Figure 11B:
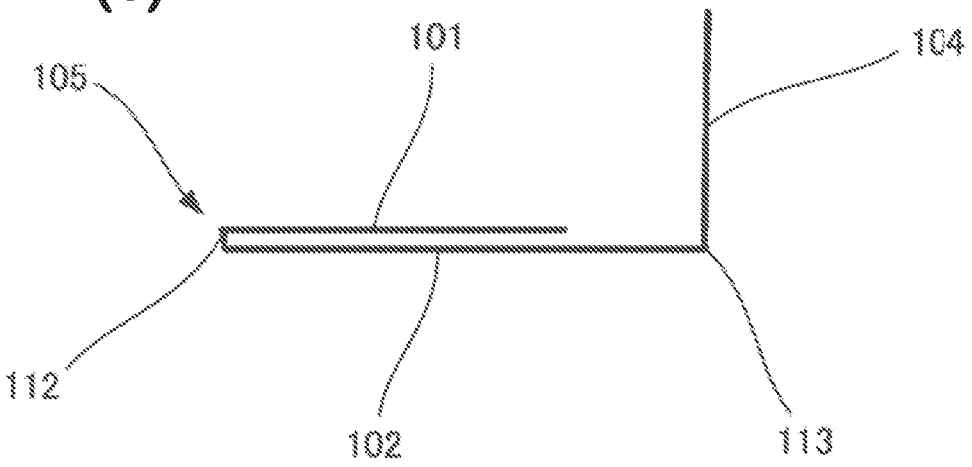

(5-7) Next, as illustrated in FIG. 11(*a*), the folding plate 62 disposed at the retracting position is lowered to the folding position in the substantially horizontal state so as to sandwich the paper sheet 100 on the switching gate plate 63, whereby the rearmost surface portion 104 of the paper sheet 100 is folded back from the third fold line 113 along the surface of the upper roller 861 of the pair of first conveyance rollers 86. At this time, a distance by which the switching gate plate 63 and the folding plate 62 after lowering approach each other is configured such that at least a gap that allows the paper sheet to be conveyed is secured between the folding plate 62 and the switching gate plate 63. For example, the gap of about 2 mm is secured.

FIG. 11(*b*) is a diagram schematically illustrating a folded state of the paper sheet 100 in FIG. 11(*a*). The front surface portion 101 of the paper sheet 100 is folded onto the rear surface portion 102 from the second fold line 112, and the rearmost surface portion 104 is folded back from the third fold line 113.

According to the above, since it is possible to fold back two positions of the front end portion (front surface portion 101) and the rear end portion (rearmost surface portion 104) in the conveyance direction of the paper sheet on the same folding mechanism, the work efficiency is good. In addition, space saving and inexpensive configuration can be achieved.

Figure 12A:
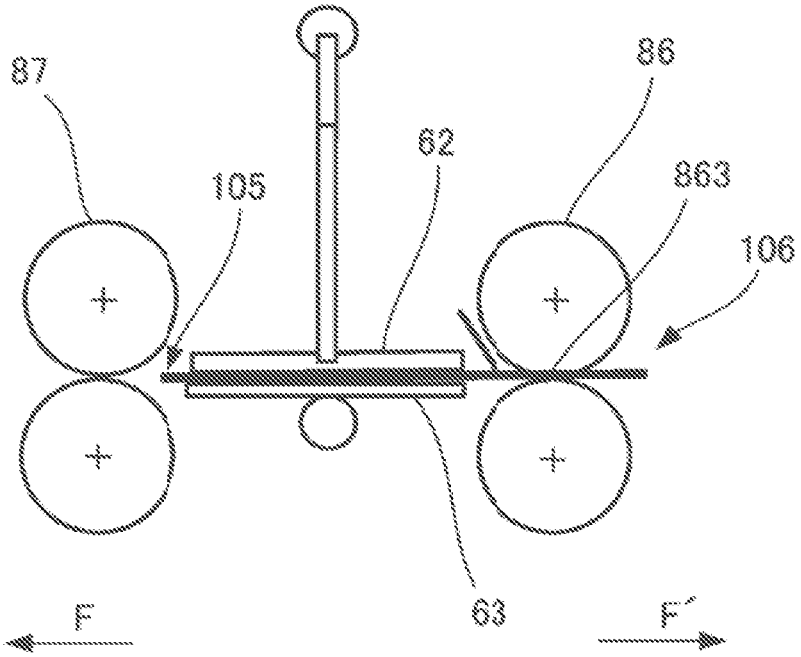
FIGS. 12(*a*) and 12(*b*) are diagrams illustrating a state of processing of the paper sheet subsequent to FIG. 11.
Figure 12B:
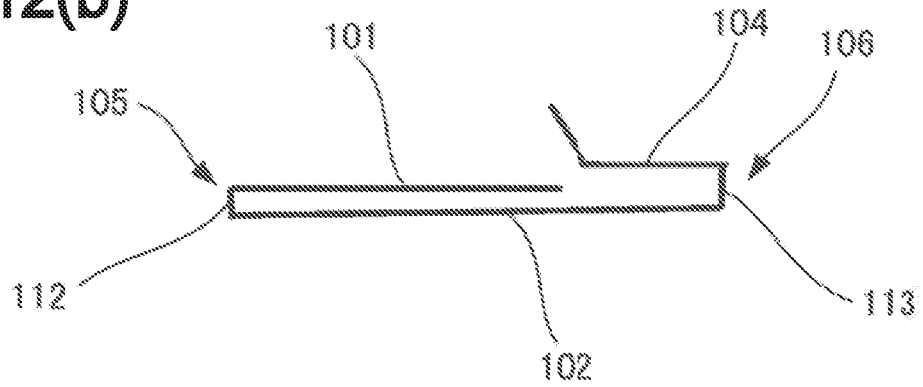

(5-8) Next, as illustrated in FIG. 12(*a*), after the rearmost surface portion 104 of the paper sheet 100 is folded back by lowering of the folding plate 62, a paper sheet rear end fold-back portion 106 after a rear end portion of the paper sheet is folded back is further conveyed toward the nip portion 863 of the pair of first conveyance rollers 86 by the pair of second conveyance rollers 87, and the paper sheet rear end fold-back portion 106 is sandwiched by the nip portion 863 of the pair of first conveyance rollers 86 and conveyed by a predetermined amount in the F' direction to press and fold the paper sheet rear end fold-back portion 106. Then, the entire rearmost surface portion 104 is folded back and aligned with the surface of the rear surface portion 102, and thereafter, the western envelope 90 as a finished product is conveyed in the F direction toward the pressurization unit 8 installed in a downstream portion of the second folding unit 6.

FIG. 12(*b*) is a diagram schematically illustrating a folded state of the paper sheet 100 in FIG. 12(*a*). The front surface portion 101 of the paper sheet 100 is folded onto the rear surface portion 102 from the second fold line 112, and the rearmost surface portion 104 is further folded onto the front surface portion 101 folded onto the rear surface portion 102 by being folded back from the third fold line 113.

According to the above, after the front end portion and the rear end portion in the conveyance direction of the paper sheet 100 are folded back by lowering of the folding plate 62, the control is performed so as to press and fold the paper sheet at the nip portions of the pair of second conveyance rollers 87 and the pair of first conveyance rollers 86, and thus, it is possible to reliably add a folding habit (fold lines) to the paper sheet.

In addition, the crease processing unit 2 is provided on the upstream side of the pair of first conveyance rollers 86 in the paper sheet conveyance direction, and the crease processing unit 2 forms creases in advance in fold lines (second fold line 112, third fold line 113) when the planar paper sheet 100 is folded to form a folding start point, so that the paper sheet can be folded cleanly and accurately. In addition, it is possible to suppress print cracking that occurs at the time of folding the paper sheet.

(6) Next, in the western envelope 90 conveyed from the second folding unit 6 to the pressurization unit 8, the folded portions 105 and 106 are sequentially sandwiched and pressurized between the upper mold 8*a* and the lower mold 8*b* of the pressurization unit 8. Therefore, the folded portions 105 and 106 become strong. The pressurized western envelope 90 is conveyed toward the paper ejection unit 7 by the pair of conveyance rollers 88, and is ejected onto the paper ejection tray 71.

As one embodiment, the case where the paper folding device (second folding unit 6) in the present invention is adopted as the paper folding mechanism in the bag making machine 10 for manufacturing the western envelope has been described, but the paper folding device (second folding unit 6) can also be implemented as a paper folding machine (paper folding device) for simply folding a paper sheet. Note that the present invention is not limited to the above embodiments, and can be implemented with various modifications.

DESCRIPTION OF REFERENCE SIGNS

F: Conveyance direction
F': Conveyance direction
R: Rotation direction
3: First folding unit
6: Second folding unit
10: Bag making machine
10A: Device body
62: Folding plate
63: Switching gate plate
64: Drive mechanism
65: Drive mechanism
100: Paper sheet
101: Front surface portion
102: Rear surface portion
103: Glue substitute piece portion
104: Rearmost surface portion
105: Fold-back portion
106: Fold-back portion
111: First fold line
112: Second fold line
113: Third fold line

The invention claimed is:

1. A paper folding device that folds a planar paper sheet while conveying the paper sheet along a paper sheet conveyance surface, the paper folding device comprising:

a pair of first conveyance rollers disposed on an upstream side in a paper sheet conveyance direction;

a pair of second conveyance rollers disposed on a downstream side in the paper sheet conveyance direction;

a switching gate plate installed on the paper sheet conveyance surface between both pairs of the rollers;

a folding plate disposed above the switching gate plate;

a first drive mechanism configured to drive the switching gate plate; and a second drive mechanism configured to drive the folding plate, wherein the switching gate plate is switchable between a first guide position at which the switching gate plate interferes with the conveyed paper sheet and guides a leading end portion of the paper sheet upward so as to pass through an upper surface of an upper roller of the pair of second conveyance rollers and a second guide position at which the switching gate plate guides the leading end portion of the paper sheet toward a nip portion of the pair of second conveyance rollers along the paper sheet conveyance surface, the folding plate is configured to be movable in a vertical direction in a substantially horizontal state, and is switchable between a folding position close to the switching gate plate disposed at the second guide position and a retracting position retracted at a predetermined interval from the switching gate plate, and the first and second drive mechanisms are configured to, after the leading end portion of the paper sheet to be conveyed is guided by the switching gate plate disposed at the first guide position so as to pass through the upper surface of the upper roller of the pair of second conveyance rollers by a predetermined amount, switch the switching gate plate to the second guide position, and then lower the folding plate disposed at the retracting position to the folding position in a substantially horizontal state so as to sandwich the paper sheet on the switching gate plate, thereby folding back the leading end portion of the paper sheet along a surface of the upper roller of the pair of second conveyance rollers.

2. The paper folding device according to claim 1, wherein after the leading end portion of the paper sheet is folded back by lowering the folding plate, a leading end fold-back portion of the paper sheet after the leading end portion of the paper sheet is folded back is further conveyed toward the nip portion of the pair of second conveyance rollers by the pair of first conveyance rollers, and the leading end fold-back portion of the paper sheet is sandwiched and conveyed by the nip portion of the pair of second conveyance rollers to press and fold the leading end fold-back portion of the paper sheet.

3. The paper folding device according to claim 2, wherein the switching gate plate is further switchable upward toward the pair of first conveyance rollers as a third guide position, the pair of first conveyance rollers and the pair of second conveyance rollers are configured to be able to perform forward rotation and reverse rotation, and the first and second drive mechanisms are configured to retract the folding plate to the retracting position and switch the switching gate plate upward toward the pair of first conveyance rollers as the third guide position after the pair of second conveyance rollers press the leading end fold-back portion of the paper sheet, then switch the switching gate plate to the second guide position to guide the paper sheet along the paper sheet conveyance surface toward a nip portion of the pair of first conveyance rollers after a rear end portion of the paper sheet is guided upward so as to pass through an upper surface of an upper roller of the pair of first conveyance rollers by a predetermined amount by reversely rotating the pair of second conveyance rollers and conveying the paper sheet in a reverse direction from the downstream side to the upstream side, and then fold back the rear end portion of the paper sheet along a surface of the upper roller of the pair of first conveyance rollers by lowering the folding plate to the folding position in a substantially horizontal state so as to sandwich the paper sheet on the switching gate plate.

4. The paper folding device according to claim 3, wherein after the folding plate is lowered to fold back the rear end portion of the paper sheet, a rear end fold-back portion of the paper sheet after the rear end portion of the paper sheet is folded back is further conveyed toward the nip portion of the pair of first conveyance rollers by the pair of second conveyance rollers, and the pair of first conveyance rollers are reversely rotated to sandwich and convey the rear end fold-back portion of the paper sheet at the nip portion of the pair of first conveyance rollers, thereby pressing the rear end fold-back portion of the paper sheet.

5. The paper folding device according to claim 1, further comprising a crease processing unit provided on the upstream side in the paper sheet conveyance direction of the pair of first conveyance rollers, wherein the crease processing unit is configured to form a crease in advance in a fold line when the planar paper sheet is folded.

6. The paper folding device according to claim 1, wherein a distance by which the switching gate plate disposed at the second guide position and the folding plate disposed at the folding position approach each other is set such that at least a gap that allows the paper sheet to be conveyed is secured between the folding plate and the switching gate plate.

7. A bag making machine comprising the paper folding device according to claim 1.

8. A paper folding device that folds a planar paper sheet while conveying the paper sheet along a conveyance surface, the paper folding device comprising:

a pair of first conveyance rollers disposed on an upstream side in a paper sheet conveyance direction;

a pair of second conveyance rollers disposed on a downstream side in the paper sheet conveyance direction;

a switching gate plate installed on a paper sheet conveyance surface between both pairs of the rollers;

a folding plate disposed to face the switching gate plate;

a first drive mechanism configured to drive the switching gate plate; and a second drive mechanism configured to drive the folding plate, wherein the switching gate plate is switchable between a first guide position at which the switching gate plate interferes with the conveyed paper sheet, bends the paper sheet conveyance direction outward from the paper sheet conveyance surface, and guides a leading end portion of the paper sheet toward a surface of one roller of the pair of second conveyance rollers and a second guide position at which the switching gate plate guides the leading end portion of the paper sheet along the paper sheet conveyance surface toward a nip portion of the pair of second conveyance rollers, the folding plate is configured to be movable toward the switching gate plate in a substantially horizontal state, and is switchable between a folding position close to the switching gate plate disposed at the second guide position and a retracting position retracted at a predetermined interval from the switching gate plate, and the first and second drive mechanisms are configured such that after the leading end portion of the paper sheet to be conveyed is guided by the switching gate plate disposed at the first guide position so as to pass by a predetermined amount toward the surface of one roller of the pair of second conveyance rollers, the switching gate plate is switched to the second guide position, and then the folding plate disposed at the retracting position is lowered to the folding position in a substantially horizontal state so as to sandwich the paper sheet on the switching gate plate, whereby the leading end portion of the paper sheet is folded back along the surface of one roller of the pair of second conveyance rollers.

* * * * *